US008187783B2

(12) United States Patent
Kikawa et al.

(10) Patent No.: US 8,187,783 B2
(45) Date of Patent: May 29, 2012

(54) METHOD OF MANUFACTURING TONER, TONER, TWO-COMPONENT DEVELOPER, DEVELOPING DEVICE AND IMAGE FORMING APPARATUS

(75) Inventors: Keiichi Kikawa, Osaka (JP); Yasuhiro Shibai, Yamatokoriyama (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 837 days.

(21) Appl. No.: 12/167,021

(22) Filed: Jul. 2, 2008

(65) Prior Publication Data

US 2009/0011358 A1 Jan. 8, 2009

(30) Foreign Application Priority Data

Jul. 2, 2007 (JP) ..... P2007-174582

(51) Int. Cl.
*G03G 9/087* (2006.01)

(52) U.S. Cl. ..... 430/137.14; 430/137.1; 430/108.1

(58) Field of Classification Search ..... 430/137.1, 430/137.14, 137.15, 137.19, 105, 108.1
See application file for complete search history.

(56) References Cited

U.S. PATENT DOCUMENTS

| | | | | |
|---|---|---|---|---|
| 5,998,078 | A * | 12/1999 | Suwabe et al. | 430/137.14 |
| 6,333,131 | B1 | 12/2001 | Ishiyama et al. | |
| 2005/0175918 | A1 * | 8/2005 | Tomita et al. | 430/108.1 |
| 2006/0068314 | A1 * | 3/2006 | Kawata | 430/110.4 |
| 2007/0065746 | A1 * | 3/2007 | Kawase et al. | 430/110.3 |

FOREIGN PATENT DOCUMENTS

| | | | |
|---|---|---|---|
| JP | 2001-228647 | A | 8/2001 |
| JP | 2002-351140 | A | 12/2002 |
| JP | 2004-020585 | A | 1/2004 |

* cited by examiner

*Primary Examiner* — Christopher Rodee
*Assistant Examiner* — Stewart Fraser
(74) *Attorney, Agent, or Firm* — Nixon & Vanderhye P.C.

(57) ABSTRACT

A method of manufacturing a toner in which uneven distribution of toner ingredients by subjecting them to fine dispersion is prevented and which is excellent in transferability, cleaning properties, anti-filming properties, anti-blocking properties, high-temperature offset resisting properties and transparency is provided. Melt-kneaded substances include binder resins, colorants and release agents, respectively. The colorant and the release agent are dispersed in the binder resin. The melt-kneaded substance is negatively charged by an anionic dispersant, whereas the melt-kneaded substance is positively charged by a cationic dispersant. An aggregate is formed by heteroaggregation of the melt-kneaded substances. The aggregate is fused by heating and formed into a spherical toner.

11 Claims, 8 Drawing Sheets

METHOD OF MANUFACTURING TONER, TONER, TWO-COMPONENT DEVELOPER, DEVELOPING DEVICE AND IMAGE FORMING APPARATUS

CROSS-REFERENCE TO RELATED APPLICATION

This application claims priority to Japanese Patent Application No. 2007-174582, which was filed on Jul. 2, 2007, the contents of which are incorporated herein by reference in its entirety.

BACKGROUND OF THE INVENTION

1. Field of the Invention

The present invention relates to a method of manufacturing a toner, a toner, a two-component developer, a developing device and image forming apparatus.

2. Description of the Related Art

In a traditional method of kneading and pulverizing, the shape and surface composition of a toner are difficult to purposefully control up to desired extents. The toner indefinite in shape cannot have sufficient fluidity even by adding thereto a fluidizing agent, and besides, such a toner has problems that the fluidizing agent deposited on the toner surface comes to be buried in hollows on the toner surface, thereby causing fluidity degradation over time, and there occur deteriorations in developability, transferability, cleaning properties and so on. As to the transferability in particular, the toner indefinite in shape has an increased adhesion force because of, e.g., an increase in number of contact points, so it tends to suffer more marked deterioration in transferability. A further increase in amount of fluidizing agent added with the intention of solving those problems causes other problems that black spots develop on a photoreceptor and, in the case of a two-component developer, adhesion of the fluidizing agent to the carrier occurs to result in the lowering of chargeability.

Such being the case, an emulsion aggregation method is proposed as a toner manufacturing method substituting for the method of kneading and pulverizing. The toner manufactured by emulsion aggregation is superior in sharpness of particle size distribution and uniformity of toner shapes, and besides, features on its manufacturing method allow extensive control of toner shapes, from spherical to irregular shapes. Therefore, excellent chargeability, transferability and cleaning properties can be attained.

In the emulsion aggregation method, a toner is generally manufactured by preparing fine dispersions of individual toner ingredients, such as a binder resin, a colorant and a release agent, mixing the dispersions to form aggregated particles of a desired toner size, and then fusing and uniting together the ingredients under heating. Although the formation of aggregated particles is generally carried out in the presence of a flocculant, the desired composition is difficult to ensure to the particles formed because the aggregates formed by addition of a flocculant are relatively weak in cohesion force and easily liberate toner ingredients including a coloring agent.

Methods hitherto proposed as solutions to such a problem aim at preventing liberation of toner ingredients by forming aggregated particles through heteroaggregation. However, since aggregation in such methods does not progress evenly in the interior of particles and uneven aggregation occurs among colorant particles, the method fails to provide a toner of a satisfactory coloring power.

According to related art disclosed in Japanese Unexamined Patent Publication JP-A 2001-228647, a fine-particle resin dispersion in which fine particles of resin 1 μm or below in size are dispersed, a colorant dispersion, a release agent dispersion and an inorganic fine-particle dispersion are mixed together and subjected to heteroaggregation, thereby preparing an aggregated particle dispersion, and then the ingredients in each aggregated particle are fused and united together by heating to a temperature higher than the glass transition temperature of the fine-particle resin. Thus, this art allows providing a toner for electrostatic charge development, which ensures high surface gloss of fixed images, high transparency in the case of output to OHP (Overhead Projector) sheet and excellent fixation characteristics including bending resistance of fixed images, and forming images of excellent quality.

According to related art disclosed in Japanese Unexamined Patent Publication JP-A 2004-20585, sulfonium group-containing cationic particles and anionic particles prepared by an in-liquid drying method are made to undergo heteroaggregation in an aqueous medium, thereby controlling presence positions of pigment (colorant) and wax in a toner so that the colorant in the toner is present more densely as its position nears the toner core, while the wax in the toner is present more densely as its position nears the toner surface. Thus, this art makes it possible to provide a toner having high charging stability under high humidity, excellent long-term running properties and a wide non-offset range.

In the related art disclosed in JP-A 2001-228647, however, the dispersibility of a colorant becomes low due to uneven aggregation, so the toner having high transparency and coloring power cannot be obtained.

In the related art disclosed in JP-A 2004-20585, on the other hand, the colorant distribution in a toner is not uniform, so the toner obtained cannot have high transparency and coloring power.

SUMMARY OF THE INVENTION

An object of the invention is to solve the problems of the arts hitherto proposed and prevent uneven distribution of toner ingredients by subjecting them to fine dispersion, and thereby to provide a method of manufacturing a toner having high transparency and coloring power, a toner manufactured according to this method, and a two-component developer, a developing device and image forming apparatus each using such a toner.

The invention provides a method of manufacturing a toner, comprising:

a melt-kneading step of melt-kneading at least a binder resin, a colorant and a release agent, a dispersion liquid preparing step of preparing two types of dispersion liquids through dispersion of a kneaded substance obtained in the melt-kneading step by use of dispersants which mutually have an opposite polarity, and an aggregating step of causing the kneaded substance heteroaggregation by mixing two types of dispersion liquids.

According to the invention, a method of manufacturing a toner comprises a melt-kneading step of melt-kneading at least a binder resin, a colorant and a release agent, a dispersion preparing step of preparing two types of dispersion liquids through dispersion of a kneaded substance obtained in the melt-kneading step by use of dispersants which mutually have an opposite polarity, and an aggregating step of causing the kneaded substance heteroaggregation by mixing two types of dispersion liquids.

Because the melt-kneaded substance is dispersed by means of dispersants, dispersibility of the melt-kneaded substance is promoted. So, granulation of the melt-kneaded substance can be carried out more easily. In addition, heteroaggregation is carried out through mixing of two types of dispersion liquids prepared by dispersing the melt-kneaded substance into each of dispersants which mutually have an opposite polarity. Therefore, at the time of aggregation of the melt-kneaded substance, melt-kneaded substances to which different polarities are imparted by dispersants which mutually have an opposite polarity are attracted to each other and aggregated readily. Thus, such dispersants further act as a flocculant. Accordingly, the amount of a flocculant added can be reduced, and the amount of flocculant remaining in the interior of the toner can be minimized. As a result, it becomes possible to avoid occurrence of excessive aggregation in the presence of a large amount of flocculant and prevent formation of a toner having a particle size greater than required and broadening of particle size distribution. In the thus manufactured toner, both a colorant and a release agent are evenly distributed, and that in a state of high degree of fine dispersion. So, the toner can have satisfactory fixability, high transparency and high coloring power. In addition, the productivity can be increased because the melt-kneaded substances which mutually have an opposite polarity can be aggregated in a short time.

Further, the invention provides a method of manufacturing a toner, comprising:

a melt-kneading step of melt-kneading at least a binder resin and a colorant, a dispersion liquid preparing step of preparing two types of dispersion liquids by dispersing a kneaded substance obtained in the melt-kneading step and a release agent by use of dispersants which mutually have an opposite polarity, and an aggregating step of causing the kneaded substance and the release agent heteroaggregation by mixing two types of dispersion liquids.

According to the invention, a method of manufacturing a toner comprises a melt-kneading step of melt-kneading at least a binder resin and a colorant, a dispersion liquid preparing step of preparing two types of dispersion liquids by dispersing a kneaded substance obtained in the melt-kneading step and a release agent by use of dispersants which mutually have an opposite polarity, and an aggregating step of causing the kneaded substance and the release agent heteroaggregation by mixing two types of dispersion liquids.

Because the melt-kneaded substance and the release agent are dispersed by means of dispersants, dispersibility of the melt-kneaded substance is promoted. So, granulation of the melt-kneaded substance can be carried out more easily. In addition, heteroaggregation is carried out mixing two types of dispersion liquids prepared by dispersing the melt-kneaded substance and the release agent into dispersants which mutually have an opposite polarity, respectively. Therefore, at the time of aggregation of the melt-kneaded substance and the release agent, the melt-kneaded substance and the release agent to which different polarities are imparted by the dispersants which mutually have an opposite polarity are attracted to each other and aggregated readily. Thus, such dispersants further act as a flocculant. Accordingly, the amount of a flocculant added can be reduced, and the amount of the flocculant remaining in the interior of the toner can be minimized. As a result, it becomes possible to avoid occurrence of excessive aggregation in the presence of a large amount of flocculant and prevent formation of toner particles of sizes greater than required and broadening of particle size distribution. In the thus manufactured toner, the colorant and the release agent are evenly distributed, and that in a state of high degree of fine dispersion. So, the toner can have satisfactory fixability, high transparency and high coloring power. In addition, the release agent can be enclosed within the melt-kneaded substance, so the content of the release agent in the toner surface can be rendered low and thereby wax bleed, blocking and so on can be prevented from occurring. Further, the productivity can be increased because the melt-kneaded substance and the release agents which mutually have an opposite polarity can be aggregated in a short time.

Further, in the invention, it is preferable that the melt-kneading step is carried out with a charge control agent added thereto.

According to the invention, the addition of a charge control agent makes it possible to control the amount of electrostatic charge with stability even under environmental changes.

Further, in the invention, it is preferable that when the volume average particle size of the release agent is denoted by a (μm), the volume average particle size of the kneaded substance is denoted by b (μm), the release agent content in the toner is denoted by c (%) and the volume average particle size of the toner is denoted by d (μm), relations of $a/10 \leqq b \leqq (d-a)/2$ and $100*\{a/(a+2b)\}^3 \geqq c$ are satisfied.

According to the invention, as far as the first relation $a/10 \geqq b \geqq (d-a)/2$ is satisfied, the release agent and the kneaded substance are easy to aggregate, and the release agent can be enclosed within the kneaded substance. Therefore, the content of the release agent in the toner surface is reduced, and occurrence of wax bleed, blocking and the like can be prevented. When "b" is smaller than a/10, the release agent and the kneaded substance are resistant to aggregation; while, when "b" is greater than (d−a)/2, the release agent cannot be enclosed adequately within the kneaded substance, and there is a fear of occurrence of wax bleed, blocking and the like.

On the other hand, as far as the second relation $100*\{a/(a+2b)\}^3 \geqq c$ is satisfied, the release agent is capable of being enclosed within the kneaded substance, so the occurrence of wax bleed, blocking and the like can be prevented.

Further, in the invention, it is preferable that the release agent is dispersed with a cationic dispersant in a case where the kneaded substance has a negative charge, whereas the release agent is dispersed with an anionic dispersant in a case where the kneaded substance a positive charge.

According to the invention, in a case where the kneaded substance has a negative charge, the toner surface is rich in an anionic dispersant because the release agent dispersed with a cationic dispersant is enclosed within the melt-kneaded substance dispersed with the anionic dispersant. Even when the anionic dispersant has remained on the toner surface, the influence of the residual anionic dispersant upon chargeability of a toner can be reduced because the toner and the dispersant have the same polarity.

In a case where the kneaded substance has a positive charge, the toner surface is rich in a cationic dispersant because the release agent dispersed with an anionic dispersant is enclosed within the melt-kneaded substance dispersed with the cationic dispersant. Even when the cationic dispersant has remained on the toner surface, the influence of the residual cationic dispersant upon the chargeability of the toner can be reduced because the toner and the dispersant have the same polarity.

Further, in the invention, it is preferable that heteroaggregation is carried out by mixing a dispersion liquid containing the kneaded substance into a dispersion liquid containing the release agent.

According to the invention, the heteroaggregation is carried out by mixing a dispersion liquid containing the kneaded substance into a dispersion liquid containing the release agent, and thereby the release agent can be properly enclosed. In addition, the control of toner particle size becomes easy because the viscosity of the solution in processing can be adjusted to the right range.

Further, in the invention, it is preferable that the dispersants which mutually have an opposite polarity are an anionic dispersant containing a polymer binding an anionic polar group to its main chain and a cationic dispersant containing a univalent, divalent or trivalent metal salt.

According to the invention, an anionic dispersant contains a polymer binding an anionic polar group to its main chain. When particles are added to an aqueous medium in the presence of the anionic dispersant, the anionic polar groups form hydrogen bonds to water molecules in the aqueous medium, and there occurs dispersion of the particles put into the aqueous medium. Thus, a dispersion of particles can be obtained.

Further, the cationic dispersant contains a univalent, divalent or trivalent metal salt. When particles are added to an aqueous medium in the presence of such a cationic dispersant, there occurs dispersion of the particles put into the aqueous medium, and thereby a dispersion liquid of particles can be obtained.

When the heteroaggregation is carried out by mixing the anionic dispersion liquid having undergone dispersion with the anionic dispersant and the cationic dispersion liquid having undergone dispersion with the cationic dispersant, bonds are formed between the anionic polar groups of the anionic dispersant and the metal ions of the univalent, divalent or trivalent metal salt of the cationic dispersant, and thereby the control of aggregation degree becomes easy and aggregates of particles uniform in size and shape can be obtained.

Further, in the invention, it is preferable that the method of manufacturing a toner comprises a heating step of carrying out heating for control of toner shape.

According to the invention, the heating makes it possible to control the toner shape extensively, from spherical to irregular shapes, and excellent chargeability, transferability and cleaning properties can be attained.

Further, in the invention, it is preferable that the heating temperature in the heating step is equal to or higher than the glass transition temperature of the binder resin, and equal to or lower than the softening temperature of the binder resin.

According to the invention, by carrying out granulation in such a temperature range, it becomes possible to control the toner shape extensively, from spherical to irregular shapes, and a toner having the intended shape and excellent transferability and cleaning properties can be obtained.

The invention provides a toner manufactured by the manufacturing method mentioned above.

According to the invention, a toner is manufactured by the manufacturing method mentioned above. The colorant and the release agent contained in the toner manufactured by the manufacturing method are evenly distributed in a high degree of fine dispersion state, so the toner has not only good fixability and high transparency but also high coloring power.

Further, in the invention, it is preferable that the toner, in a state of being formed into a toner film on a transparent sheet, has a transmittance of 85% or higher at a maximum transmission wavelength of the toner film having a thickness providing a transmittance of 3% at a wavelength where the toner film shows maximum absorption in a wavelength range of 400 nm to 700 nm.

According to the invention, this toner is high in transparency.

Further, the invention provides a two-component developer comprising the toner and a carrier.

According to the invention, since a two-component developer comprises the toner achieving the effect as mentioned above and a carrier, images of high density and high quality can be formed by use of the two-component developer.

Further, the invention provides a developing device which performs development using the above-mentioned two-component developer.

According to the invention, the developing device can form high-quality toner images of high density on a photoreceptor by performing development with the two-component developer achieving the effect as mentioned above.

Further, the invention provides an image forming apparatus having the above-mentioned developing device.

According to the invention, the image forming apparatus can form high-quality images of high density by using the developing device achieving the effect as mentioned above.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
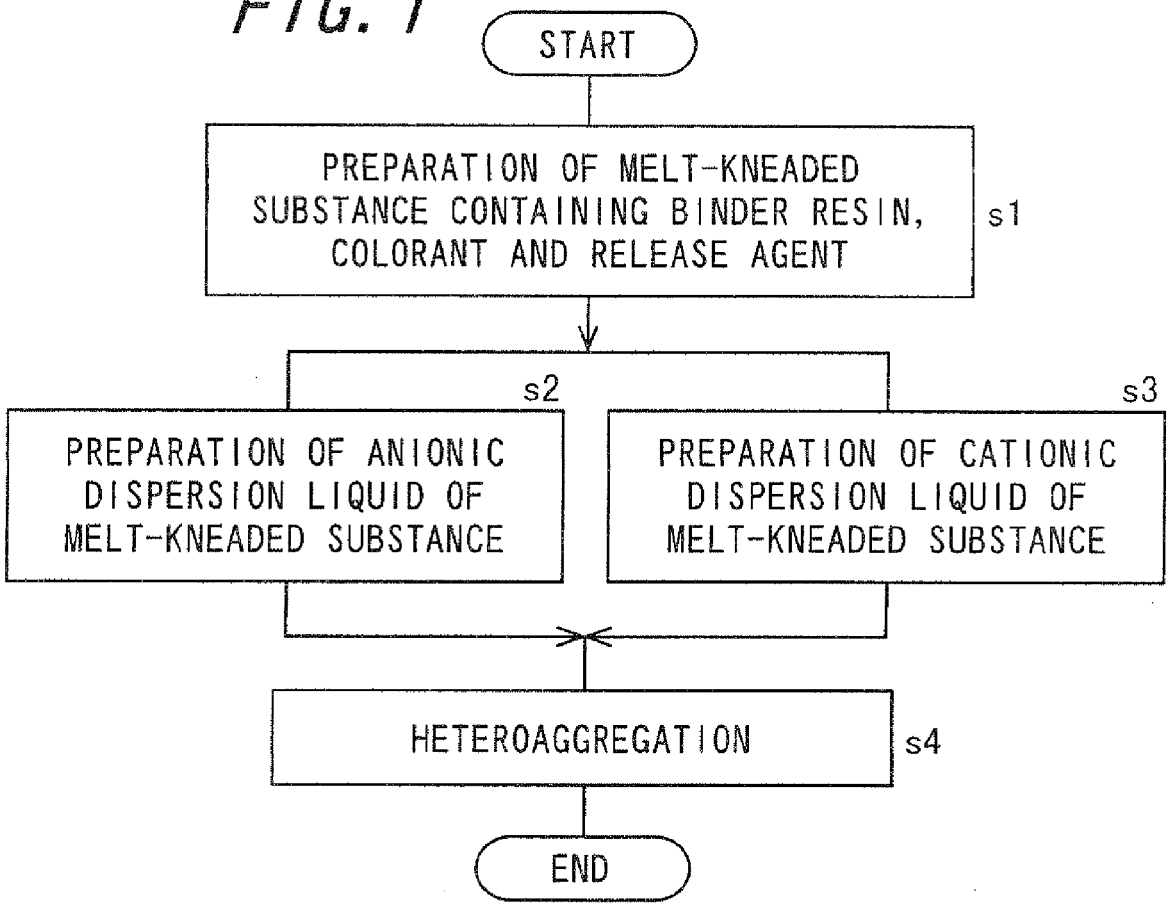
FIG. 1 is a flowchart illustrating a first method of manufacturing a toner according to the invention.

Now referring to the drawings, preferred embodiments of the invention are described below.

Multiple embodiments of the invention are described below. In the following description, there are cases where reference marks are put in the parts corresponding to the matters already described in the embodiments precedent to each embodiment and overlapping descriptions are omitted. When only a part of the makeup is described, the other parts of the makeup are assumed to be identical with those described in the preceding embodiments. In addition to combinations of concretely described parts in individual embodiments of the invention, it is also possible to partially combine embodiments so long as the resultant combinations cause no particular trouble.

<Method of Manufacturing Toner>

FIG. 1 is a flowchart illustrating a first method of manufacturing a toner according to the invention. In accordance with the first method of manufacturing the toner according to the invention, two types of dispersion liquids are prepared by dispersing a melt-kneaded substance into each of dispersants which mutually have an opposite polarity, and subjected to heteroaggregation. The toner manufactured by the first method of manufacturing the toner according to the invention is used in image forming apparatus utilizing electrophotography, such as copiers, laser-beam printers and facsimiles. The first method of manufacturing the toner according to the invention includes a step of preparing a melt-kneaded substance containing a binder resin, a colorant and a release agent (Step s1), a step of preparing an anionic dispersion liquid of melt-kneaded substance (Step s2), a step of preparing a cationic dispersion liquid of melt-kneaded substance (Step s3), and a heteroaggregation step (Step s4).

<Step of Preparing Melt-Kneaded Substance Containing Binder Resin, Colorant and Release Agent (Step s1)>

Toner ingredients including a binder resin, a colorant and a release agent are melt-kneaded. The melt-kneaded substance thus obtained is solidified by cooling, then pulverized and, if needed, subjected to classification, thereby preparing particles of the melt-kneaded substance containing the binder resin, the colorant and the release agent.

<Binder Resin>

Examples of a binder resin include an acrylic resin, a polyester resin, a polyurethane resin and an epoxy resin. Of these resins, an acrylic resin is especially suitable for use, because it is easy to disperse. The acrylic resin usable as the binder resin, though not limited to particular one, is preferably an acrylic resin having acidic groups. The acrylic resin having acidic groups can be produced by polymerization reaction using as an acrylic resin monomer or a combination of acrylic resin monomer and vinyl monomer, e.g., an acrylic resin monomer containing an acidic group or a hydrophilic group, or a combination of an acrylic resin monomer with a vinyl monomer containing an acidic group or a hydrophilic group. As the acrylic resin monomer, heretofore known acrylic resin monomers can be used, wherein are included acrylic acid which may have a substituent, methacrylic acid which may have a substituent, an acrylic acid ester which may have a substituent and a methacrylic acid ester which may have a substituent. Examples of an acrylic resin monomer include acrylate monomers, such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate and dodecyl acrylate; methacrylate monomers, such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate and dodecyl methacrylate; and (meth) acrylate monomers containing hydroxyl groups, such as hydroxyethyl acrylate and hydroxypropyl methacrylate. Herein, acrylic resin monomers may be used alone, or two or more kinds of them may be used in combination. As the vinyl monomers, heretofore known vinyl monomers can also be used, with examples including styrene, α-methylstyrene, vinyl bromide, vinyl chloride, vinyl acetate, acrylonitrile and methacrylonitrile. Herein, vinyl monomers also may be used alone or two or more kinds of them may be used in combination. The polymerization is carried out using a general radical initiator in accordance with a solution polymerization method, a suspension polymerization method or an emulsion polymerization method.

A polyester resin is superior in transparency, and can impart satisfactory powder flowability, low-temperature fixability, secondary color reproducibility and so on to resultant toner particles, so it is especially suitable as the binder resin of a color toner. Heretofore known polyester resins can be used as the binder resin, wherein are included polycondensates of polybasic acids and polyhydric alcohols. As the polybasic acids, those known to be usable as polyester monomers can be used, with examples including aromatic carboxylic acids, such as terephthalic acid, isophthalic acid, phthalic anhydride, trimellitic anhydride, pyromellitic acid and naphthalenedicarboxylic acid; aliphatic carboxylic acids, such as maleic anhydride, fumaric acid, succinic acid, alkenylsuccinic anhydride and adipic acid; and methyl esters of these polybasic acids. Polybasic acids may be used alone or two or more kinds of them may be used in combination. In the case of the polyhydric alcohols, those known to be usable as polyester monomers can be used, with examples including aliphatic polyhydric alcohols, such as ethylene glycol, propylene glycol, butanediol, hexanediol, neopentyl glycol and glycerol; alicyclic polyhydric alcohols, such as cyclohexanediol, cyclohexane dimethanol and hydrogenated bisphenol A; and aromatic diol compounds, such as ethylene oxide adducts of bisphenol A and propylene oxide adducts of bisphenol A. Polyhydric alcohols may be used alone or two or more kinds of them may be used in combination. Polycondensation reaction between polybasic acid and polyhydric alcohol can be carried out in the usual manner. For example, the reaction is initiated by bringing polybasic acid and polyhydric alcohol into contact with each other in the presence of a polycondensation catalyst, wherein an organic solvent may be either present or absent, and finished when the polyester produced comes to have the intended acid value, softening temperature and so on. Thus, polyester can be obtained. When the methyl ester of polybasic acid is used as a portion of polybasic acid, demethanolated polycondensation reaction occurs. In such polycondensation reaction, appropriate changes of the compounding ratio between the polybasic acid and the polyhydric alcohol, the reaction rate and so on allow, e.g., not only adjustment to the carboxyl group content in the ends of polyester but also modification to characteristics of resultant polyester. When trimellitic anhydride is used as polybasic acid, on the other hand, carboxyl groups can be easily introduced into the main chain of polyester, and modified polyester can be obtained. Alternatively, an acrylic resin may be grafted onto polyester.

As the binder resin, heretofore known polyurethane resins can be used. For example, a polyurethane resin having acidic groups or basic groups can be used to advantage. The polyurethane resin having acidic or basic groups can be produced by heretofore known methods. For example, it can be produced by addition polymerization of diol or polyol having an acidic or basic group with polyisocyanate. Examples of diol having an acidic or basic group include dimethylolpropionic acid and N-methyldiethanolamine. Examples of polyol having an acidic or basic group include polyether polyol, such as polyethylene glycol, polyester polyol, acryl polyol and polybutadiene polyol. Examples of polyisocyanate include tolylene diisocyanate, hexamethylene diisocyanate and isophorone diisocyanate. As to each of these ingredients, only one compound may be used, or two or more compounds may be used in combination.

The epoxy resin usable as binder resin, though not limited to particular one, is preferably an epoxy resin having acidic or basic groups. The epoxy resin having acidic or basic groups can be produced, e.g., by allowing a polycarboxylic acid, such as adipic acid or trimellitic anhydride, or an amine, such as dibutylamine or ethylenediamine, to undergo addition to or addition polymerization with an epoxy resin as a base.

Of these binder resins, the resins having softening temperatures of 150° C. or below, especially from 60° C. to 150° C., are preferable to the others in view of their capabilities of effecting easy fine granulating, being kneaded properly with a colorant and a release agent and rendering the shape and size of toner particles uniform. Of the binder resins having softening points in the foregoing range, binder resins having their weight average molecular weight in a range of 5,000 to 500,000 are preferred over the others. These binder resins may be used alone or two or more kinds of them may be used in combination. Moreover, resins which are the same in kind but different in either molecular weight, monomer composition or so on, or all of them may be used together.

<Colorant>

Examples of a colorant usable herein include organic dyes, organic pigments, inorganic dyes and inorganic pigments.

Examples of a black colorant include carbon black, copper oxide, manganese dioxide, Aniline Black, activated carbon, nonmagnetic ferrite, magnetic ferrite and magnetite.

Examples of a yellow colorant include chrome yellow, zinc chromate, cadmium yellow, yellow iron oxide, Mineral Fast Yellow, Nickel Titan Yellow, Navel Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Yellow Lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94 and C.I. Pigment Yellow 138.

Examples of an orange colorant include chrome orange, molybdenum orange, Permanent Orange GTR, Pyrazolone Orange, Vulcan Orange, Indanthrene Brilliant Orange RK, Benzidine Orange G, Indanthrene Brilliant Orange GK, C.I. Pigment Orange 31 and C.I. Pigment Orange 43.

Examples of a red colorant include red iron oxide, cadmium red, red lead, red mercury sulfide, cadmium, Permanent Red 4R, Lithol Red, Pyrazolone Red, Watching Red, calcium salt, Lake Red C, Lake Red D, Brilliant Carmine 6B, Eosine Lake, Rhodamine Lake B, alizarin lake, Brilliant Carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 222.

Examples of a violet colorant include manganese violet, Fast Violet B and Methyl Violet Lake.

Examples of a blue colorant include iron blue, cobalt blue, Alkali Blue Lake, Victoria Blue Lake, Phthalocyanine Blue, metal-free Phthalocyanine Blue, Phthalocyanine Blue partial chloride, Fast Sky Blue, Indanthrene Blue BC, C.I. Pigment Blue 15, C.I. Pigment Blue 15:2, C.I. Pigment Blue 15:3, C.I. Pigment Blue 16 and C.I. Pigment Blue 60.

Examples of a green colorant include chrome green, chromium oxide, Pigment Green B, Malachite Green Lake, Final Yellow Green G and C.I. Pigment Green 7.

Examples of a white colorant include hydrozincite, titanium oxide, antimony white and zinc sulfide.

These colorants may be used alone. Alternatively, two or more colorants different in kind and color may be used in combination, or two or more colorants having the same color but differing in kind may be used in combination. The amount of colorant(s) used has no particular limitations, but it is preferable to use colorant(s) in a proportion of 3 parts by weight or more and 10 parts by weight or less on the basis of 100 parts by weight of binder resin.

A colorant or colorants are preferably used in a state of masterbatch. The masterbatch of colorant can be prepared, e.g., by kneading the colorant with a synthetic resin. As the synthetic resin, a binder resin of the same kind as the binder resin used as a toner ingredient or a binder resin having a good compatibility with the binder resin used as a toner ingredient is used. The usage ratio between the synthetic resin and the colorant has no particular limitations, but the colorant is preferably used in a proportion of 30 parts by weight or more and 100 parts by weight or less on the basis of 100 parts by weight of synthetic resin. The masterbatch is pulverized into particles having a size of about 2 to 3 mm, and then used. The use of a colorant in the state of masterbatch, can enhance dispersibility of the colorant in the binder resin, and allows uniform-and-fine dispersion of the colorant in the toner obtained via the steps mentioned below.

<Release Agent>

In embodiments of the invention, a release agent is included in ingredients of the toner. Addition of a release agent to the toner allows prevention of high-temperature offset. The term "high-temperature offset" as used herein refers to the phenomenon that, in the case of a hot-roller fixing method in which a toner is fixed by heating with a heating roller, an excess of toner is molten at the time of fixing and part of the molten toner is taken off through fusion into the heating roller for fixing use.

An example of the release agent is wax. Examples of wax include natural wax, such as carnauba wax or rice wax; synthetic wax, such as polypropylene wax, polyethylene wax or Fischer-Tropush wax; coal wax, such as montan wax; petroleum wax, such as paraffin wax; alcohol wax; and ester wax. These release agents may be used alone, or two or more kinds of them may be used in combination. Of those release agents, carnauba wax is preferred over the others because of its superior affinity for binder resins.

It is preferable that the release agent used herein has a melting point of 80° C. or below. The melting point of the release agent higher than 80° C. causes a fear that, at the time of fixing of the toner to a recording medium by heating with a hot roller, there occurs low-temperature offset that fusion of the release agent does not occur and the fixing of the toner to a recording medium ends in failure. Therefore, the low-temperature offset can be avoided by use of the release agent having a melting point of 80° C. or below. In addition, because the softening temperature of the toner as a whole can be lowered by use of the release agent having a melting point of 80° C. or below, improvement in low-temperature fixability can be attained. As a result, power consumption in a fixing section required for fixing by using a heating section such as a heater, can be reduced.

It is far preferable that the melting point of the release agent is 60° C. or higher and 80° C. or lower. When the melting point of the release agent is lower than 60° C., there is a fear that the release agent melts in the melt-kneading step, and a viscosity differential between the release agent and the binder resin becomes great; as a result, dispersing the release agent into the binder resin becomes difficult. In addition, there is a fear that toner particles aggregate inside the image forming apparatus to cause degradation in storage stability. Accordingly, the use of a release agent having its melting point of 60° C. or higher and 80° C. or lower makes it possible to provide a toner which not only has high storage stability attributable to uniform dispersion of a release agent into a binder resin but also avoids causing low-temperature offset.

It is preferable that the release agent is present in a proportion of 3 parts by weight or more and 15 parts by weight or less on the basis of 100 parts by weight of binder resin. When the release agent is present in an amount smaller than 3 parts by weight, its releasing effect cannot be achieved adequately, and there is a fear of high-temperature offset. On the other hand, when the release agent content is larger than 15 parts by weight, there is a fear of forming a thin film of release agent on the surface of a photoreceptor, namely a fear of causing filming. Accordingly, by adjusting the release agent content to the range of 3 parts by weight or more and 15 parts by weight or less on the basis of 100 parts by weight of binder resin, it becomes possible to prevent both filming and high-temperature offset from occurring. Additionally, it is far preferable that the release agent content is 5 parts by weight or more and 15 parts by weight or less on the basis of 100 parts by weight of binder resin. When the release agent is in such a content range, occurrence of filming and high-temperature offset can be prevented with reliability.

<Charge Control Agent>

Additives including a charge control agent may be added to toner ingredients. By addition of a charge control agent, the amount of electrostatic charge can be controlled with stability under environmental changes. Charge control agents usable for such a purpose include positive charge control agents and negative charge control agents which are generally used in the field of electrophotography. Examples of the positive charge control agents include basic dyes, quaternary ammonium salts, quaternary phosphonium salts, aminopyrine, pyrimidine compounds, polynuclear polyamino compounds, aminosilanes, derivatives of nigrosine dyes, triphenylmethane derivatives, guanidine salts and amidine salts. Examples of the negative charge control agents include oil-soluble dyes, such as Oil Black and Spilon Black, metal-containing azo compounds, azo complex dyes, metal salts of naphthenic acid, metal complexes and metal salts of salicylic acid and its derivatives (wherein the metals include chromium, zinc and zirconium), fatty acid soap, salts of long-chain alkanecarboxylic acid, and resin acid soap. These charge control agents may be used alone, or two or more kinds of them may be used in combination, if needed. The usage of charge control agent has no particular limitations, and can be chosen appropriately from a wide range. However, it is advantageous for the agent to be used in a proportion of 0.5 to 3 parts by weight on the basis of 100 parts by weight of binder resin.

The toner ingredients including a binder resin, a colorant, a release agent, and additives used as required, such as a charge control agent, are subjected to dry mixing with a mixing machine. Then, the resultant mixture is heated up to a temperature equal to or higher than the softening temperature of the binder resin, and that lower than the thermal decomposition temperature, and subjected to melt-kneading. By this procedure, the binder resin is softened, and the colorant, the release agent and so on are dispersed into the binder resin. Although the toner ingredients including a binder resin, a colorant and a release agent may be subjected to melt-kneading without undergoing dry mixing, it is preferred that they be subjected to melt-kneading after undergoing dry mixing, because this procedure can ensure improvement in dispersibility of toner ingredients other than the binder resin, including the colorant and the release agent, into the binder resin and enables equalization of properties of the toner to be formed, including chargeability.

Examples of a mixing machine usable for dry mixing include Henschel-type mixing machines, such as HENSCHEL MIXER (trade name, made by Mitsui Mining Co., Ltd.), SUPERMIXER (tradename, made by KAWATA MEG Co., Ltd.) and MECHANOMILL (trade name, made by Okada Seiko Co., Ltd.), ANGMILL (trade name, Hosokawa Micron Corporation), HYBRIDIZATION SYSTEM (trade name, Nara Machinery Co., Ltd.) and COSMOSYSTEM (trade name, Kawasaki Heavy Industries, Ltd.).

For melt-kneading, kneading machines, such as a kneader, a biaxial extrusion machine, a two-rod roll mill, a three-rod roll mill and a laboplast mill, can be used. Examples of such kneading machines include uniaxial and biaxial extruders, such as TEM-100B (trade name, made by Toshiba Machine Co., Ltd.), PCM-65/87 and PCM-30 (trade names, made by Ikegai Ltd.), and open-roll kneading machines, such as KNEADEX (trade name, made by Mitsui Mining Co., Ltd.). The melt-kneading may be carried out using more than one kneading machine.

By melt-kneading of a binder resin, a colorant, a release agent and additives added as required, the colorant, the release agent and the additives are dispersed uniformly into the binder resin. Herein, it is preferable that the colorant and the release agent are dispersed uniformly into the binder resin so as to become sufficiently smaller in size than a melt-kneaded substance to be formed which ranges in volume average particle size from 0.4 to 2.0 μm. For uniform dispersion of the colorant and the release agent into the binder resin, it is preferable that the kneading temperature is adjusted to a favorable temperature.

Favorable kneading temperatures are explained below by an example of an open-roll kneading machine. In the case of using an open-roll kneading machine, fine dispersion of a colorant and a release agent into a binder resin can be carried out by appropriately choosing a temperature of rolls on the ingredient mixture feeding side and a temperature of rolls on the melt-kneaded substance taking-out side. As to the melt-kneading temperature, it is preferable that the temperature of a heating roll on the ingredient mixture feeding side is adjusted to a temperature equal to or higher than the softening temperature of the binder resin, and that lower than the thermal decomposition temperature of the binder resin. More specifically, in the case of using a polyester resin (glass transition temperature: 56° C., softening temperature: 110° C.) as the binder resin, it is preferable that the temperature of a heating roll on the ingredient mixture feeding side is adjusted to a range of 140° C. to 170° C. and the temperature of a cooling roll on the ingredient mixture feeding side is adjusted to a range of 40° C. to 70° C. By adjustment to these appropriate kneading temperatures, a favorable viscosity can be given to the melt-kneaded substance and sufficient shear force can be applied to the melt-kneaded substance. Therefore, the colorant and the release agent can be dispersed into the binder resin uniformly with sizes sufficiently smaller than a melt-kneaded substance to be formed which ranges in volume average particle size from 0.2 to 2.0 μm. It is advantageous for the colorant particles dispersed in the toner to have a dispersion diameter of 100 nm (0.1 μm) to 500 nm (0.5 μm).

It is preferable that the thus obtained melt-kneaded substance containing the binder resin, the colorant and the release agent is subjected to coarse pulverization after it is solidified by cooling. Before the melt-kneaded substance is dispersed with a dispersant, solidified matter of the melt-kneaded substance is pulverized in advance to coarse powder of favorable sizes. Depending on the type of a high-pressure homogenizer used and so on, the coarse pulverization is preferably carried out to a degree that the melt-kneaded substance comes to have a volume average particle size of the order of 100 μm. The volume average particle sizes far exceeding 100 μm increase sedimentation speeds of the melt-kneaded substance in an anionic dispersion liquid and a cationic dispersion liquid during the following dispersion step including the step of preparing an anionic dispersion liquid of melt-kneaded substance and the step of preparing a cationic dispersion liquid of melt-kneaded substance, so it is difficult to keep the melt-kneaded substance in a state of uniform dispersion. On the other hand, there's no need to pulverize the melt-kneaded substance to a degree that its volume average particle size becomes far smaller than 100 μm by daring to increase the number of step steps. The method for coarse pulverization of solidified matter of the melt-kneaded substance has no particular restrictions. The coarse pulverization of solidified matter of the melt-kneaded substance is carried out by means of a crusher, a hammer mill, an atomizer, a feather mill, a jet mill or the like.

The coarse pulverization of the melt-kneaded substance may also be carried out after mixing of the melt-kneaded substance and an aqueous medium in the following steps of preparing an anionic dispersion liquid of melt-kneaded substance and a cationic dispersion liquid of melt-kneaded substance respectively.

<Step of Preparing Anionic Dispersion Liquid of Melt-Kneaded Substance (Step s2)>

The step of preparing the anionic dispersion liquid of melt-kneaded substance (Step s2) includes a dispersing stage and a finely granulating stage.

At the dispersing stage, the melt-kneaded substance containing a binder resin, a colorant and a release agent is mixed with an aqueous medium and an anionic dispersant, and the melt-kneaded substance is dispersed into the aqueous medium in the presence of the anionic dispersant. Thus, the dispersion liquid of melt-kneaded substance is prepared. As the aqueous medium, it is suitable to use purified water which can be prepared by an activated charcoal method, an ion exchange method, a distillation method or a reverse osmosis method.

At the finely granulating stage, the dispersion liquid is stirred as shear force is imposed thereon under applied heat and pressure until the melt-kneaded substance is finely granulated into particles of desired sizes.

It is preferable that the melt-kneaded substance is used at a proportion of 3 parts by weight or more and 40 parts by weight or less on the basis of 100 parts by weight of aqueous medium. And it is far preferable that the melt-kneaded substance is used in a proportion of 5 parts by weight or more and 25 parts by weight or less on the basis of 100 parts by weight of aqueous medium.

When the proportion of the melt-kneaded substance is lower than 3 parts by weight, the melt-kneaded substance concentration is low, so there is a fear that the melt-kneaded substance becomes difficult to aggregate in the following heteroaggregation step. On the other hand, when, the proportion of the melt-kneaded substance used is higher than 40 parts by weight, the distance between melt-kneaded substance particles becomes too short, and there is a fear that it becomes difficult to perform aggregation to an appropriate degree. In addition, the dispersion liquid comes to have too high viscosity to be stirred properly. Therefore, the proportion of the melt-kneaded substance is adjusted to the foregoing range, and thereby the aggregation degree of particles in the following heteroaggregation step can be made suitable. Thus, a toner of suitable size can be obtained.

Examples of an anionic dispersant usable herein include hitherto known dispersants, such as sulfonic acid-type anionic dispersants, sulfate-type anionic dispersants, polyoxyethylene ether-type anionic dispersants, phosphate-type anionic dispersants and polyacrylic acid salts. More specifically, sodium dodecylbenzenesulfonate, sodium polyacrylate, polyoxyethylene phenyl ether and the like can be used to advantage. Anionic dispersants may be used alone, or two or more kinds of them may be used in combination.

Of those anionic dispersants, anionic dispersants containing polymers binding an anionic polar group to their main chains are preferred over the others. When particles are added to an aqueous medium in the presence of such an anionic dispersant, the anionic polar groups form hydrogen bonds to water molecules, so the particles put into the aqueous medium are dispersed. Thus, a dispersion liquid of particles can be obtained. Additionally, it is possible to use such an anionic polymeric dispersant in combination with a small amount of low molecular anionic dispersant, typified by sodium dodecylbenzenesulfonate.

It is preferable that the anionic dispersants are used in a proportion of 3 parts by weight or more and 10 parts by weight or less on the basis of 100 parts by weight of melt-kneaded substance. When the proportion of anionic dispersants used is lower than 3 parts by weight, the amount of anionic dispersants is too small compared with the amount of melt-kneaded substance, so dispersibility of the melt-kneaded substance is depressed. On the other hand, when the proportion of anionic dispersants used is higher than 10 parts by weight, the amount of anionic dispersants is too large compared with the amount of melt-kneaded substance and dispersibility of the melt-kneaded substance becomes too high, so there is a fear that aggregation in the following heteroaggregation step becomes difficult.

The dispersing stage is done by putting the aqueous medium, the anionic dispersant(s) and the melt-kneaded substance into the tank of, e.g., a high-pressure homogenizer or a colloid mill and stirring these ingredients. The time period required for running the dispersing stage, though it has no particular limitations, is preferably 5 minutes or longer and 30 minutes or shorter. By adjusting the running time of the dispersing stage to such a range, the melt-kneaded substance can be dispersed thoroughly into the aqueous medium.

Alternatively, the dispersing stage may be done by putting the aqueous medium and the melt-kneaded substance into the tank of, e.g., a high-pressure homogenizer or a colloid mill, thoroughly pulverizing the melt-kneaded substance, and further putting the anionic dispersant (s) into the tank with stirring. The dispersing stage has no particular limitations to the time period required for running, but the time period required for the pulverization prior to the input of the anionic dispersant (s) is preferably 5 minutes or longer and 30 minutes or shorter. And the time period required for the subsequent stirring is preferably 5 minutes or longer and 30 minutes or shorter. By adjusting the running time of the dispersing stage to such a range, the melt-kneaded substance can be dispersed thoroughly into the aqueous medium.

The dispersion liquid obtained at the dispersing stage is delivered to the finely granulating stage. At the finely granulating stage, the melt-kneaded substance contained in the dispersion is pulverized finely. More specifically, the melt-kneaded substance is pulverized into finer particles so that the particles have their volume average particle size of 0.4 μm or more and 2.0 μm or less. At the finely granulating stage, the melt-kneaded substance in the dispersion liquid is pulverized under application of heat and pressure, and then the resultant dispersion liquid is subjected to cooling decompression.

The finely granulating stage is done by a high-pressure homogenizer method. The high-pressure homogenizer method is a method of performing fine pulverization of a melt-kneaded substance by using a high-pressure homogenizer or the like under a pressurized condition. The high-pressure homogenizer used is a device for crushing particles under heating and pressurization.

Then, the dispersion after the melt-kneaded substance undergoes fine pulverization is cooled, and gradually decompressed to a pressure under which no air bubble is evolved. It is preferable that the decompression is carried out stepwise at a slow pace. Although there is no restriction as to the cooling temperature and pressure, it is preferable that the dispersion is cooled to a temperature of 40° C. or below and decompressed to atmospheric pressure. By cooling the dispersion immediately after the fine pulverization and then decompressing the cooled dispersion to a pressure under which no air bubble is evolved, not only evolution of bubbles in the dispersion but also coarsening of the melt-kneaded substance by re-aggregation can be prevented.

The finely granulating stage at which the pulverization and cooling decompression are carried out may be repeated two or more times as required. And the finely granulating stage is pursued until the melt-kneaded substance in the dispersion liquid comes to have its volume average particle size in a range of 0.4 μm or more and 2.0 μm or less. When the volume average particle size of the melt-kneaded substance is smaller than 0.4 μm, the melt-kneaded substance becomes too minute, so there is a fear that the colorant and the release agent are not dispersed uniformly into the binder resin of the melt-kneaded substance. On the other hand, when the volume average particle size of the melt-kneaded substance is larger than 2.0 μm, there is a fear that a toner having small particle sizes of, e.g., 4 μm or more and 8 μm or less is difficult to form. For forming the toner of such small particle sizes, it is more advantageous for the melt-kneaded substance to have a volume average particle size of 0.4 μm or more and 1.0 μm or less.

As the high-pressure homogenizer used at the dispersing stage and the finely granulating stage, heretofore known ones including commercially available devices can be adopted. Examples of a commercially available high-pressure homogenizer include chamber-type high-pressure homogenizers, such as MICROFLUIDIZER (trade name, made by Microfluidics Corporation), NANOMIZER (trade name, made by Nanomizer Inc.) and ULTIMIZER (trade name, made by Sugino Machine Limited), HIGH-PRESSURE HOMOGENIZER (trade name, made by Rannie Manufacturing Company), HIGH-PRESSURE HOMOGENIZER (trade name, made by Sanmaru Machinery Co., Ltd.), HIGH-PRESSURE HOMOGENIZER (trade name, made by Izumi Food Machinery Co., Ltd.) and FOAMLESS MIXER (trade name, made by Beryu Co., Ltd.).

Alternatively, it is possible to use a granulator of high-speed rotary dispersion type by which application of torque or both torque and shear force is effected. Examples of a commercially available granulator of high-speed rotary dispersion type include CREAMIX (trade name, made by M TECHNIQUE Co., LTD.) and T.K. HOMO MIXER MARK II (trade name, made by PRIMIX Corporation). These granulators are also referred to as double-motion or single-motion granulators or emulsion machines. And they further serve as pumps. In these granulators each, a liquid to be processed (dispersion liquid) is sucked from the suction port by utilizing pressure differentials developed between the suction port and the discharge port by high-speed rotation of the turbine. Strong actions generated by rotation of the turbine, such as actions of shear-force, crush, impact and turbulent-flow, allow fine pulverization, mixing, stirring, emulsification and dispersion of the dispersion liquid sucked in.

In addition, general mixing apparatus including batch-type emulsion machines and dispersion machines may be used. The emulsion machines and dispersion machines of such a type are each furnished with a mixing tank having a heating section, a stirring section capable of applying a shear force to a dispersion liquid, a rotating section and a heat insulating section. Examples of such emulsion and dispersion machines include batch-type emulsion machines, such as ULTRA-TURRAX (trade name, made by IKA Japan), POLYTRON HOMOGENIZER (trade name, made by KINEMATICA AG), T.K. AUTO HOMO MIXER (trade name, made by PRIMIX Corporation); and continuous emulsion machines, such as EBARA MILDER (trade name, made by EBARA Corporation), T.K. PIPELINE HOMO MIXER (trade name, made by PRIMIX Corporation), T.K. HOMOMIC LINE FLOW (tradename, made by PRIMIX Corporation), T.K. FILMICS (trade name, made by PRIMIX Corporation), COLLOID MILL (trade name, made by Shinko Pantec Co., Ltd.), SLUSHER (trade name, made by Mitsui Miike Machinery Co., Ltd.), TRIGONAL WET PULVERIZER (trade name, made by Mitsui Miike Machinery Co., Ltd.), CAVITRON (tradename, made by Eurotec Ltd.) and FINE FLOW MILL (trade name, made by Pacific Machinery & Engineering Co., Ltd.).

<Step of Preparing Cationic Dispersion Liquid of Melt-Kneaded Substance (Step s3)>

There are cases where descriptions of items overlapping with the already described items of the step of preparing the anionic dispersion of melt-kneaded substance (Step s2) are omitted.

Although hitherto known cationic dispersants are usable, those suitable for use include cationic dispersants of alkyltrimethylammonium type, cationic dispersants of alkylamidoamine type, cationic dispersants of alkyldimethylbenzylammonium type, cationic dispersants of cationized polysaccharide type, cationic dispersants of alkylbetaine type, cationic dispersants of alkylamidobetaine type, cationic dispersants of sulfobetaine type, and cationic dispersants of amineoxide type. Of these cationic dispersants, cationic dispersants of alkyltrimethylaminonium type are preferred over the others. Examples of a cationic dispersant of alkyltrimethylammonium type include stearyltrimethylammonium chloride, tri(polyoxyethylene)stearylammonium chloride and lauryltrimethylammonium chloride. The cationic dispersants as recited above may be used alone, or two or more kinds of them may be used in combination.

It is particularly advantageous for the cationic dispersant used herein to contain a salt of univalent to trivalent metal. When particles are added to an aqueous medium in the presence of such a cationic dispersant, the particles put into the aqueous medium are dispersed. Thus, a dispersion liquid of particles is obtained.

Examples of a univalent metal salt include salts containing sodium such as sodium chloride. Examples of a divalent metal salt include salts containing magnesium such as magnesium chloride, and salts containing calcium such as calcium chloride. Examples of a trivalent metal salt include salts containing aluminum such as aluminum chloride. Of the divalent metal salts, calcium carbonate in particular is suitable for an auxiliary use because it has low solubility in water and its effect is mild. On the other hand, strongly-basic salts, such as hydroxides, are undesirable because they induce hydrolysis of resins when heated.

The cationic dispersants are preferably used in a proportion of 2 parts by weight or more and 6 parts by weight or less on the basis of 100 parts by weight of melt-kneaded substance. When the proportion of cationic dispersants used is lower than 2 parts by weight, the amount of cationic dispersants is too small compared with the amount of melt-kneaded substance, so dispersibility of the melt-kneaded substance is depressed. On the other hand, when the proportion of cationic dispersants used is higher than 6 parts by weight, the amount of cationic dispersants is too large compared with the amount of melt-kneaded substance and dispersibility of the melt-kneaded substance becomes too high, so there is a fear that aggregation in the following heteroaggregation step becomes difficult.

The ratio between the anionic dispersants used in Step s2 and the cationic dispersants used in Step s3 has no particular limitations. However, in consideration of easiness of control on sizes of aggregated particles, probability of aggregation, prevention of excessive aggregation and further reduction in width of the particle size distribution of aggregated particles, the usage ratio between anionic and cationic dispersants is preferably from 3:2 to 5:1 by weight.

<Heteroaggregation Step (Step s4)>

The anionic dispersion liquid prepared in the step of preparing the anionic dispersion liquid of melt-kneaded substance (Step s2) and the cationic dispersion liquid prepared in the step of preparing the cationic dispersion liquid of melt-kneaded substance (Step s3) are mixed together to cause heteroaggregation.

In each dispersion, the melt-kneaded substance is dispersed with either an anionic dispersant or a cationic dispersant, so it is charged either negatively or positively and dispersed in the form of ions. The thus oppositely charged melt-kneaded substances are brought into aggregation by neutralization of charges via adsorption reaction between ions of opposite polarities.

The heteroaggregation can be carried out by means of the same apparatus as used for carrying out the step of preparing the anionic dispersion liquid of melt-kneaded substance (Step s2) or the step of preparing the cationic dispersion liquid of melt-kneaded substance (Step s3).

In the heteroaggregation step, it is appropriate that a flocculant be added. In the invention, the dispersants used also act as flocculant, but flocculating power is insufficient unless any flocculant is added. So, addition of a flocculant is favorable for making a toner grow to a volume average particle size of 4 μm or more and 8 μm or less as described later. As the flocculant, a metal salt is suitable for use. Examples of metal salts usable as flocculants are univalent metal salts including salts of alkali metals, such as sodium, potassium and lithium, divalent metal salts including salts of alkaline earth metals, such as calcium, magnesium and barium, and other divalent metals, such as manganese and copper, and trivalent metal salts, such as iron salts and aluminum salts. More specifically, it is possible to use sodium chloride, potassium chloride, lithium chloride or the like as the univalent metal salt, or calcium chloride, barium chloride, magnesium chloride, magnesium hydroxide, zinc chloride, copper sulfate, magnesium sulfate, manganese sulfate or the like as the divalent metal salt, or aluminum chloride, aluminum hydroxide, aluminum sulfate, ferric chloride or the like as the trivalent metal salt. The flocculant can be chosen from these salts as appropriate. Of these salts, sodium salts are best suited to controlling the particle sizes of aggregated particles because salts of sodium having an ionic valence of one are mild in flocculation speed as compared with salts of magnesium having an ionic valence of two and salts of aluminum having an ionic valence of three. The metal salts as recited above may be used alone, or two or more kinds of them may be used in combination. The amount of flocculant (s) used is preferably from 0.5 to 20 parts by weight, far preferably from 0.5 to 18 parts by weight, and particularly preferably from 1.0 to 18 parts by weight, on the basis of 100 parts by weight of the total amount of binder resin, colorant and release agent used. When the amount of flocculant (s) used is smaller than 0.5 parts by weight, there is a fear that flocculating effect become insufficient; while, when the amount of flocculant (s) used is greater than 20 parts by weight, there is a fear that toner particles formed becomes too large.

When a toner comes to have suitable particle sizes, e.g., a volume average particle size of 4 μm or more and 8 μm or less, the toner is isolated from the dispersion liquid, and washed with purified water. Thereafter, the toner is dried. Examples of a method of isolating the toner from the dispersion liquid include general separation methods, such as filtration and centrifugation methods. The conductivity of purified water used for washing is preferably 20 μS/cm or below. The purified water having such a conductivity can be obtained by an activated charcoal method, an ion exchange method, a distillation method or a reverse osmosis method. The temperature of purified water used is preferably from about 10° C. to about 80° C. It is appropriate that the washing be carried out until the conductivity of spent wash water (water after washing) is lowered to 50 μS/cm or below.

According to such a method of manufacturing a toner, the melt-kneaded substance is dispersed with dispersants, so the dispersibility of the melt-kneaded substance is enhanced and granulation of the melt-kneaded substance can be more easily carried out. Furthermore, heteroaggregation is carried out by mixing two types of dispersion liquids wherein the melt-kneaded substance is dispersed with each of dispersants which mutually have an opposite polarity. So, melt-kneaded substances rendered which mutually have an opposite polarity by the dispersants which mutually have an opposite polarity are attracted to each other when they are subjected to the aggregating step. Thus, the melt-kneaded substance becomes easy to aggregate. In this way, the dispersants also act as a flocculant. Therefore, the amount of flocculant added can be reduced, and the amount of flocculant remaining inside the toner can be minimized. As a result, it becomes possible to prevent excessive aggregation caused by addition of a large amount of flocculant, and thereby to prevent formation of toner particles having sizes greater than required and avoid increase in the width of particle size distribution. The thus manufactured toner is free of uneven distribution of the colorant and the release agent in the toner and contains the colorant and the release agent in a state of high level of fine dispersion, so it can have satisfactory fixability, high transparency and high coloring power. In addition, the melt-kneaded substances which mutually have an opposite polarity can be aggregated in a short time, so the productivity can be enhanced.

Figure 2A:
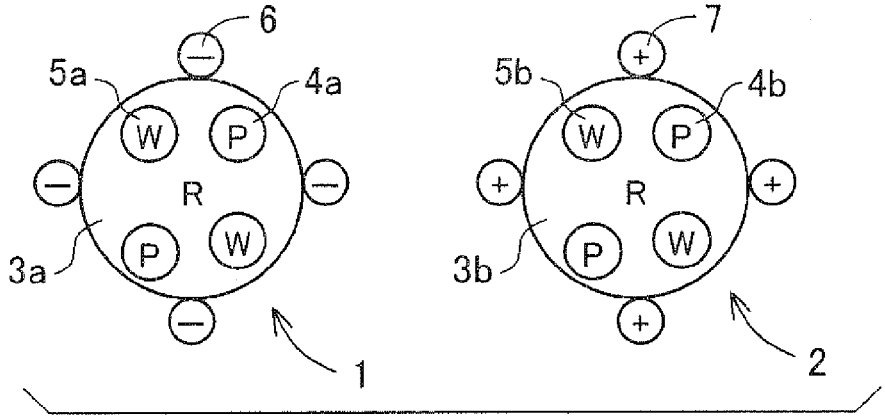
FIGS. 2A to 2C are schematic views illustrating the first method of manufacturing a toner according to the invention.
Figure 2B:
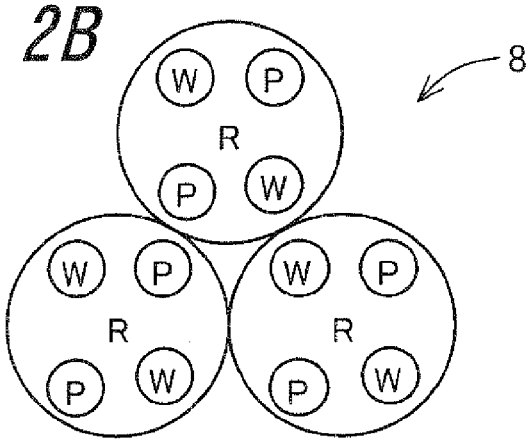
Figure 2C:
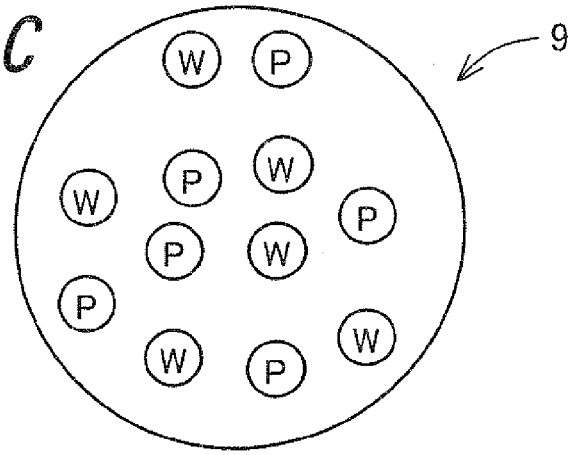

FIGS. 2A to 2C are schematic views illustrating the first method of manufacturing the toner according to the invention.

FIG. 2A shows a melt-kneaded substance 1 and a melt-kneaded substance 2 before heteroaggregation. The melt-kneaded substance 1 includes a binder resin 3*a*, a colorant 4*a* and a release agent 5*a*. The melt-kneaded substance 2 includes a binder resin 3*b*, a colorant 4*b* and a release agent 5*b*. In each melt-kneaded substance, the colorants 4*a* and 4*b* and the release agents 5*a* and 5*b* are dispersed in the binder resin 3*a* and 3*b*. The melt-kneaded substance 1 is negatively charged by an anionic dispersant 6, while the melt-kneaded substance 2 is positively charged by a cationic dispersant 7.

FIG. 2B shows an aggregate 8 after heteroaggregation. The aggregate 8 is formed by aggregation of more than one melt-kneaded substance 1 and more than one melt-kneaded substance 2.

FIG. 2C shows a toner 9 after heating of the aggregate 8. The aggregate 8 is fused by heating and formed into a spherical toner 9.

Figure 3:
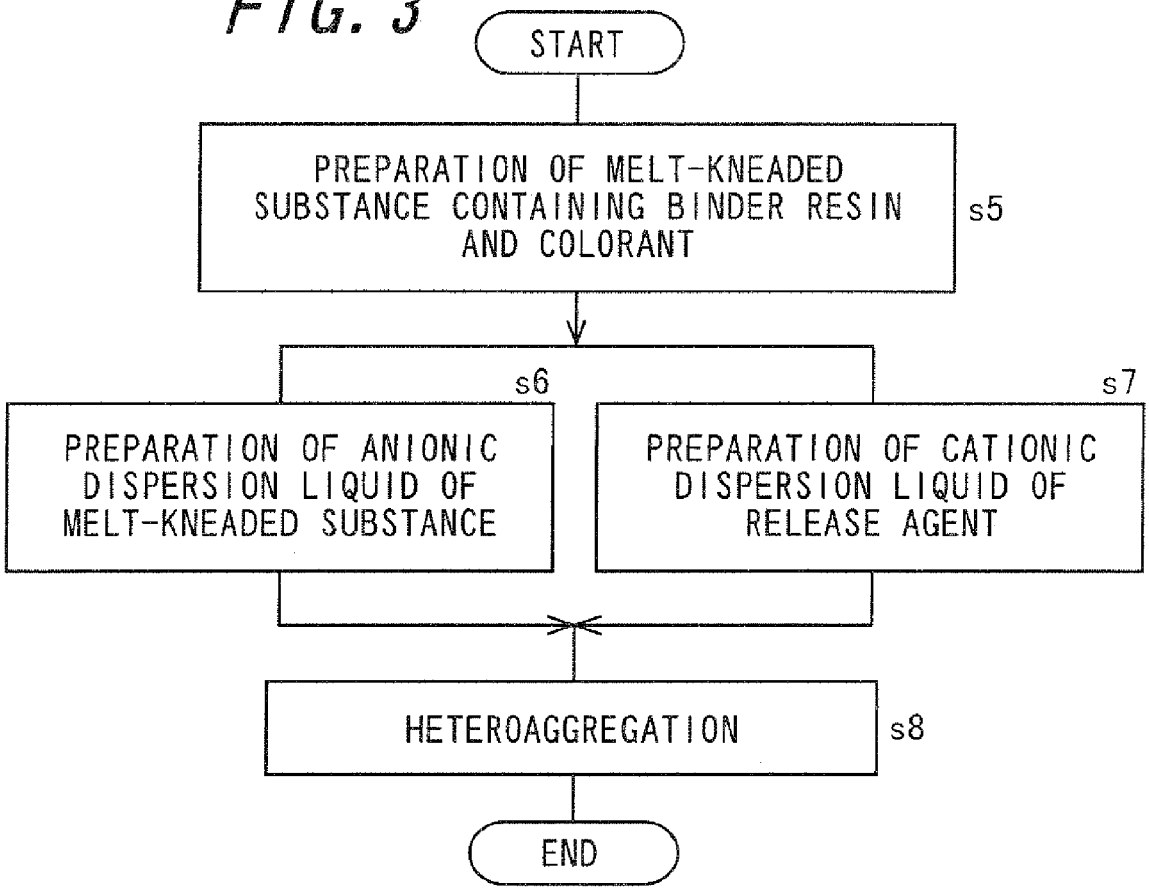
FIG. 3 is a flowchart illustrating a second method of manufacturing a toner according to the invention.

FIG. 3 is a flowchart illustrating a second method of manufacturing a toner according to the invention. In accordance with the second method of manufacturing the toner according to the invention, two types of dispersion liquids are prepared by dispersing a melt-kneaded substance and a release agent by use of dispersants which mutually have an opposite polarity, and subjected to heteroaggregation. The second method of manufacturing the toner according to the invention includes a step of preparing a melt-kneaded substance containing a binder resin and a colorant (Step s5), a step of preparing an anionic dispersion liquid of melt-kneaded substance (Step s6), a step of preparing a cationic dispersion liquid of release agent (Step s1), and a heteroaggregation step (Step s8).

Descriptions overlapping with those of the first method of manufacturing the toner according to the invention will be occasionally omitted.

<Step of Preparing Melt-Kneaded Substance Containing Binder Resin and Colorant (Step s5)>

Except for absence of a release agent in the melt-kneaded substance, this step (Step s5) is identical with the step of preparing the melt-kneaded substance containing a binder resin, a colorant and a release agent (Step s1).

<Step of Preparing Anionic Dispersion Liquid of Melt-Kneaded Substance (Step s6)>

This step (Step s6) is also identical with the step of preparing the anionic dispersion liquid of melt-kneaded substance, except that the melt-kneaded substance made into an anionic dispersion liquid is a melt-kneaded substance containing a binder resin and a colorant instead of the melt-kneaded substance containing a binder resin, a colorant and a release agent (Step s2).

<Step of Preparing Cationic Dispersion Liquid of Release Agent (Step s7)>

In a step of preparing a cationic dispersion of release agent, a release agent, an aqueous medium and a cationic dispersant are mixed together and, e.g., in room-temperature surroundings, the release agent is dispersed into the aqueous medium in the presence of the cationic dispersant, thereby preparing a dispersion liquid of release agent. As the release agent, the same compounds as used in Step s1 are usable. The aqueous medium suitably used herein is purified water which can be prepared by an activated charcoal method, an ion exchange method, a distillation method or a reverse osmosis method.

The release agent is preferably used in a proportion of 3 parts by weight or more and 50 parts by weight or less on the basis of 100 parts by weight of melt-kneaded substance. And it is far preferable that the release agent is used in a proportion of 5 parts by weight or more and 25 parts by weight or less on the basis of 100 parts by weight of melt-kneaded substance.

When the proportion of the release agent used is lower than 3 parts by weight, the release agent concentration is insufficient and there is a fear that aggregation in the following heteroaggregation step becomes difficult. On the other hand, when the proportion of the release agent used is higher than 50 parts by weight, the distance between release agent particles becomes too short, and there is a fear that it becomes difficult to attain an appropriate degree of aggregation. In addition, the dispersion liquid obtained has too high viscosity, and it becomes impossible to stir the dispersion liquid adequately. Therefore, the aggregation degree of particles in the heteroaggregation step can be made optimum by adjusting the proportion of the release agent to the range specified above. Thus, a toner of proper particle size can be obtained.

Hitherto known cationic dispersants can also be used herein, but those preferably used are, e.g., cationic dispersants of alkyltrimethylammonium type, cationic dispersants of alkylamidoamine type, cationic dispersants of alkyldimethylbenzylammonium type, cationic dispersants of cationized polysaccharide type, cationic dispersants of alkylbetaine type, cationic dispersants of alkylamidobetaine type, cationic dispersants of sulfobetaine type, and cationic dispersants of amineoxide type. Of these cationic dispersants, cationic dispersants of alkyltrimethylammonium type are far preferable to the others. Examples of a cationic dispersant of alkyltrimethylammonium type include stearyltrimethylammonium chloride, tri(polyoxyethylene)stearylammonium chloride and lauryltrimethylammonium chloride. The cationic dispersants as recited above may be used alone, or two or more kinds of them may be used in combination.

It is particularly advantageous for the cationic dispersant used herein to contain a salt of univalent to trivalent metal. When particles are added to an aqueous medium in the presence of such a cationic dispersant, there occurs dispersion of the particles put into the aqueous medium. Thus, a dispersion liquid of particles is obtained.

Examples of a univalent metal salt include salts containing sodium such as sodium chloride. Examples of a divalent metal salt include salts containing magnesium such as magnesium chloride, and salts containing calcium such as calcium chloride. Examples of a trivalent metal salt include salts containing aluminum such as aluminum chloride. Of the divalent metal salts, calcium carbonate in particular is suitable for an auxiliary use because it has low solubility in water and its effect is mild. On the other hand, strongly-basic salts, such as hydroxides, are undesirable because they induce hydrolysis of resins under heating.

The cationic dispersants are preferably used in a proportion of 2 parts by weight or more and 6 parts by weight or less on the basis of 100 parts by weight of release agent. When the proportion of cationic dispersants used is lower than 2 parts by weight, the cationic dispersants used are too small in amount with respect to the release agent used, so dispersibility of the release agent is depressed. On the other hand, when the proportion of cationic dispersants used is higher than 6 parts by weight, the cationic dispersants used are too large in amount with respect to the release agent used and dispersibility of the release agent becomes too high, so there is a fear that aggregation in the following heteroaggregation step becomes difficult.

The ratio between the anionic dispersants used in Step s6 and the cationic dispersants used in Step s7 has no particular limitations. However, in consideration of easiness of control on sizes of aggregated particles, probability of aggregation, prevention of excessive aggregation and further reduction in width of the particle size distribution of aggregated particles, the usage ratio between anionic and cationic dispersants is preferably from 3:2 to 5:1 by weight.

The step of preparing a cationic dispersion liquid of release agent is done by putting the aqueous medium, the cationic dispersant(s) and the release agent into the tank of, e.g., a nigh-pressure homogenizer or a colloid mill and stirring these ingredients. The dispersing stage has no particular limitations to the time period required for running, but the time period required for the dispersing stage is preferably 5 minutes or longer and 30 minutes or shorter. By adjusting the time period required for the dispersing stage to such a range, the release agent can be dispersed thoroughly into the aqueous medium.

Alternatively, the dispersing stage may be done by putting the aqueous medium and the release agent into the tank of, e.g., a high-pressure homogenizer or a colloid mill, thoroughly pulverizing the release agent, and further putting the cationic dispersant(s) into the tank with stirring. The dispersing stage has no particular limitations to the time period required for running, but the time period required for the pulverization prior to the input of the cationic dispersant (s) is preferably 5 minutes or longer and 30 minutes or shorter. And the time for the subsequent stirring is preferably 5 minutes or longer and 30 minutes or shorter. By adjusting the time period required for the dispersing stage to such a range, the release agent can be dispersed thoroughly into the aqueous medium.

As the high-pressure homogenizer used herein, heretofore known ones including commercially available devices can be adopted. Examples of a commercially available high-pressure homogenizer include chamber-type high-pressure homogenizers, such as MICROFLUIDIZER (trade name, made by Microfluidics Corporation), NANOMIZER (trade name, made by Nanomizer Inc.) and ULTIMIZER (trade name, made by Sugino Machine Limited), HIGH-PRESSURE HOMOGENIZER (trade name, made by Rannie Manufacturing Company), HIGH-PRESSURE HOMOGENIZER (tradename, made by Sanmaru Machinery Co., Ltd.), HIGH-PRESSURE HOMOGENIZER (trade name, made by Izumi Food Machinery Co., Ltd.) and FOAMLESS MIXER (trade name, made by Beryu Co., Ltd.).

Alternatively, it is possible to use a granulator of high-speed rotary dispersion type by which application of torque or both torque and shear force is effected. Examples of a commercially available granulator of high-speed rotary dispersion type include CREAMIX (trade name, made by M TECHNIQUE Co., LTD.) and T.K. HOMO MIXER MARK II (trade name, made by PRIMIX Corporation). These granulators are also referred to as double-motion or single-motion granulators or emulsion machines. And they further serve as pumps. In these granulators each, a liquid to be processed (dispersion liquid) is sucked from the suction port by utilizing pressure differentials caused between the suction port and the discharge port by high-speed rotation of the turbine. Strong actions generated by rotation of the turbine, such as shear-force, pulverizing, impacting and turbulent-flow actions, allow fine pulverization, mixing, stirring, emulsification and dispersion of the dispersion liquid sucked in.

In addition, general mixing apparatus including batch-type emulsion machines and dispersion machines may be used. The emulsion machines and dispersion machines of such a type are each furnished with a mixing tank having a heating section, a stirring section capable of applying a shear force to a dispersion liquid, a rotating section and a heat insulating section. Examples of such emulsion and dispersion machines include batch-type emulsion machines, such as ULTRA-TURRAX (trade name, made by IKA Japan), POLYTRON HOMOGENIZER (trade name, made by KINEMATICA AG), T.K. AUTO HOMO MIXER (trade name, made by PRIMIX Corporation); and continuous emulsion machines, such as EBARA MILDER (trade name, made by EBARA Corporation), T.K. PIPELINE HOMO MIXER (trade name, made by PRIMIX Corporation), T.K. HOMOMIC LINE FLOW (tradename, made by PRIMIX Corporation), T.K. FILMICS (trade name, made by PRIMIX Corporation), COLLOID MILL (trade name, made by Shinko Pantec Co., Ltd.), SLUSHER (trade name, made by Mitsui Miike Machinery Co., Ltd.), TRIGONAL WET PULVERIZER (tradename, made by Mitsui Miike Machinery Co., Ltd.), CAVITRON (trade name, made by Eurotec Ltd.) and FINE FLOW MILL (trade name, made by Pacific Machinery & Engineering Co., Ltd.).

<Heteroaggregation Step (Step s8)>

This step (Step s8) is identical with the heteroaggregation step s4.

In addition, it is especially preferable that heteroaggregation is carried out by mixing the dispersion liquid containing the kneaded substance into the dispersion liquid containing the release agent. By doing so, the release agent can be enclosed with reliability. Moreover, the viscosity of the solution under processing can be adjusted to just the right range, so the size control of toner particles becomes easy.

According to such a method of manufacturing a toner, both the melt-kneaded substance and the release agent are dispersed with dispersants, so the dispersibility of the melt-kneaded substance is enhanced and granulation of the melt-kneaded substance can be more easily carried out. In addition, the heteroaggregation is carried out by mixing two types of dispersion liquids in which the melt-kneaded substance and the release agent are dispersed with dispersants which mutually have an opposite polarity, respectively. Therefore, the melt-kneaded substance and the release agent which mutually have an opposite polarity are attracted to each other by the dispersants which mutually have an opposite polarity when they are subjected to the aggregation processing, and aggregation is apt to occur. In this way, the dispersants further act as a flocculant. Accordingly, the amount of flocculant added can be reduced, and the amount of flocculant remaining inside the toner can be minimized. As a result, it becomes possible to prevent excessive aggregation caused by addition of a large amount of flocculant, and thereby to prevent formation of toner particles having sizes greater than required and avoid increase in the width of particle size distribution. The thus manufactured toner is free of uneven distribution of the colorant and the release agent in the toner and contains the colorant and the release agent in a state of high level of fine dispersion, so it can have satisfactory fixability, high transparency and high coloring power. In addition, the content of release agent in the toner surface can be reduced because it is possible to enclose the release agent within the melt-kneaded substance. So, wax bleed, blocking and the like can be prevented from occurring. Moreover, the melt-kneaded substance and the release agent which mutually have an opposite polarity can be aggregated in a short time, so the productivity can be enhanced.

Thus, in the case of manufacturing a toner for negative charging use, that is, in the case where the kneaded substance has a negative charge, it is preferable that the release agent is dispersed with a cationic dispersant.

In the case of the toner for negative charging use, the release agent dispersed with a cationic dispersant is enclosed within the melt-kneaded substance dispersed with an anionic dispersant, so the toner surface is rich in the anionic dispersant. Even when the anionic dispersant is left on the toner surface, the dispersant has the same polarity as the toner has, so its influence on the changeability of the toner can be lessened.

Conversely, in the case of manufacturing the toner for positive charging use, that is, in the case where the kneaded substance has a positive charge, it is preferable that the release agent is dispersed with an anionic dispersant.

In the case of a toner for positive charging use, the release agent dispersed with an anionic dispersant is enclosed within the melt-kneaded substance dispersed with a cationic dispersant, so the toner surface is rich in the cationic dispersant. Even when the cationic dispersant is left on the toner surface, the dispersant has the same polarity as the toner has, so its influence on the chargeability of the toner can be lessened.

Figure 4A:
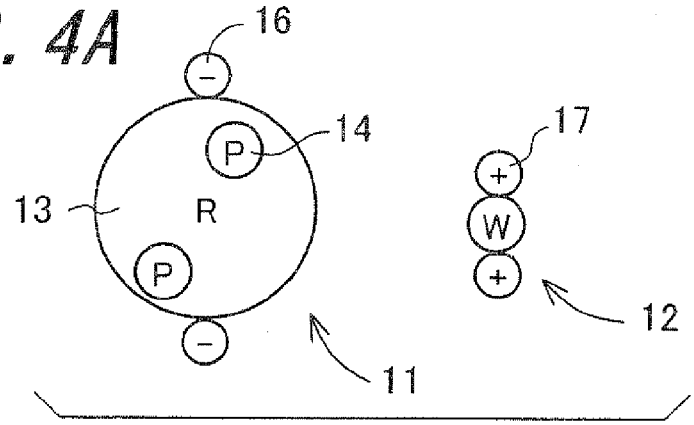
FIGS. 4A to 4C are schematic views illustrating the second method of manufacturing a toner according to the invention.
Figure 4B:
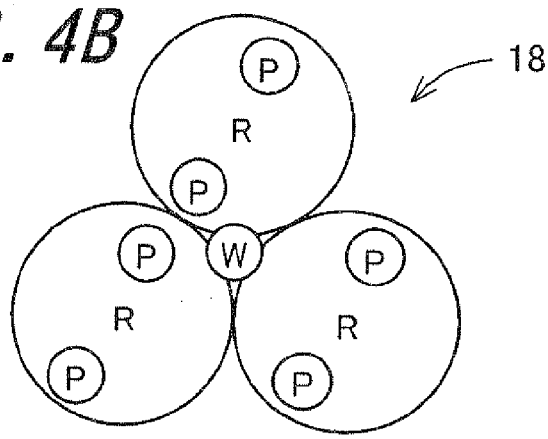
Figure 4C:
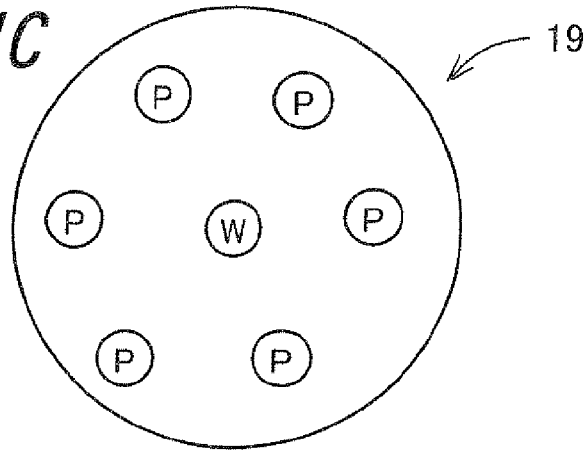

FIGS. 4A to 4C are schematic views illustrating the second method of manufacturing the toner according to the invention.

FIG. 4A shows a melt-kneaded substance 11 and a release agent 12 before heteroaggregation. The melt-kneaded substance 11 is made up of a binder resin 13 and a colorant 14. The colorant is dispersed in the binder resin. The melt-kneaded substance 11 is negatively charged by an anionic dispersant 16, while the release agent 12 is positively charged by a cationic dispersant 17.

FIG. 4B shows an aggregate 18 after heteroaggregation. The aggregate 18 is formed by aggregation of more than one melt-kneaded substance 11 and more than one release agent 12.

FIG. 4C shows a toner 19 after heating of the aggregate 18. The aggregate 18 is fused by heating and formed into a spherical toner 19.

Figure 5:
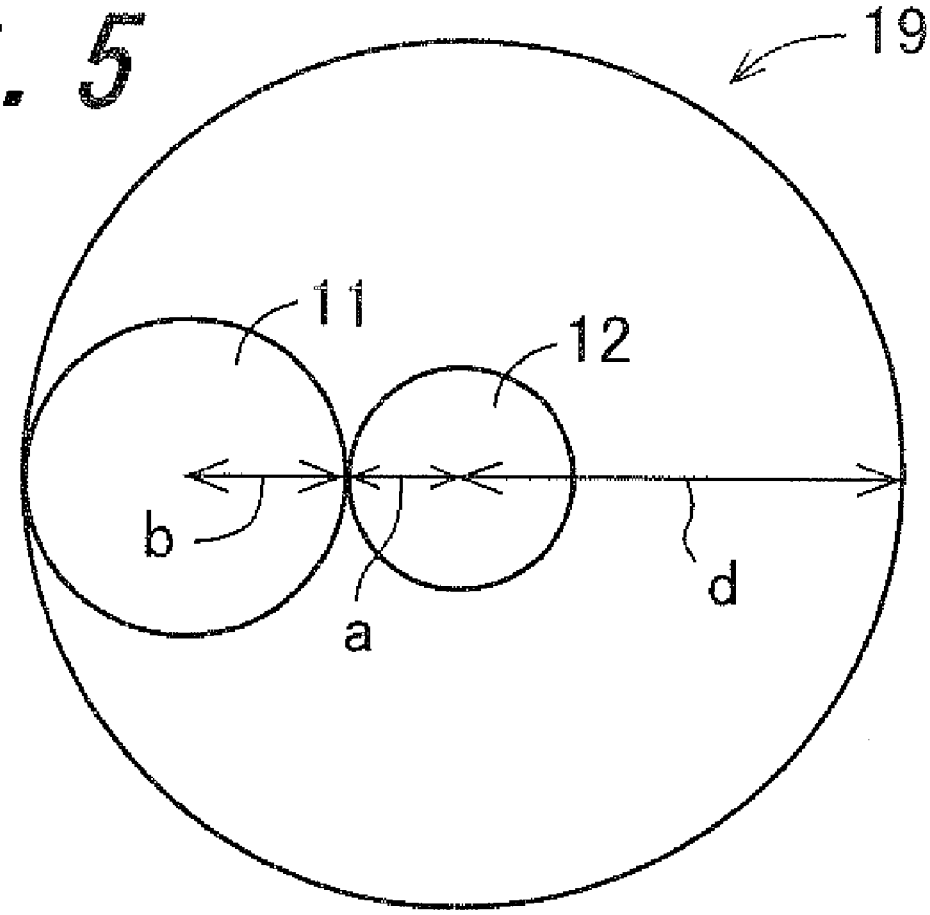
FIG. 5 is a schematic view of a toner according to the invention.

FIG. 5 is a schematic view of the toner 19 according to the invention. The release agent 12 is enclosed within the melt-kneaded substance 11.

In the toner 19 according to the invention, it is preferable that the volume average particle size of the release agent 12, a (μm), the volume average particle size of the melt-kneaded substance 11, b (μm), the release agent 12 content in the toner 19, c (%), and the volume average particle size of the toner 19, d (μm), satisfy the following expressions (1) and (2).

$$a/10 \leqq b \leqq (d-a)/2 \quad (1)$$

$$100*\{a/(a+2b)\}^3 \geqq c \quad (2)$$

As far as the expression (1) is satisfied, the release agent 12 and the melt-kneaded substance 11 become easy to aggregate, and the release agent 12 can be enclosed within the melt-kneaded substance 11. Therefore, the content of the release agent 12 in a surface of the toner 19 can be reduced, thereby allowing prevention of wax bleed, blocking and the like. When "b" is smaller than "a/10", the release agent 12 and the melt-kneaded substance 11 becomes difficult to aggregate. When "b" is greater than (d−a)/2, on the other hand, it becomes impossible to adequately enclose the release agent 12 within the melt-kneaded substance 11, so there is a fear that wax bleed, blocking and the like occur.

As far as the expression (2) is satisfied, the release agent 12 is enclosed properly within the melt-kneaded substance 11, so occurrences of wax bleed, blocking and the like can be prevented.

An explanation of the expression (1) is given below. As long as at least one layer of melt-kneaded substance 11 is formed around the release agent 12, "d" does not become smaller than "a+2b". So, the following expression (3) can hold.

$$d \geqq a+2b \quad (3)$$

Seeking the solution of the expression (3) to "b", the following expression (4) is derived.

$$b \leqq (d-a)/2 \quad (4)$$

When the left and right sides are equal in the expression (4), the melt-kneaded substance 11 is present in a single layer on the surface of the release agent 12. When the value on the left side is half the value on the right side, the melt-kneaded substance 11 is present in a double layer around the release agent 12.

Since aggregation becomes hard to occur when "b" is too small compared with a, it is preferable to choose, e.g., one-tenth or above of the value "a" as the lower limit of b. Pulverizing the melt-kneaded substance 11 before aggregation to particles of a radius b smaller than "a/10" implies that a fine powder is formed from particles of the melt-kneaded substance 11 to result in undesirable broadening of the width of particle size distribution of the melt-kneaded substance 11.

Then, the expression (2) is explained below. The release agent content c can be expressed by the following expression (5).

$$c=100(a/d)^3 \quad (5)$$

Therefore, the expression (2) can be derived from the expression (3) and the expression (5).

When the left and right sides are equal in the expression (2), the melt-kneaded substance 11 is present in a single layer around the release agent 12. When the melt-kneaded substance 11 is present in a double layer around the release agent 12, the value of "b" becomes small; as a result, the denominator put in braces on the left side becomes small and the value on the left side becomes greater than the value on the right side. Accordingly, when the left and right sides are equal, "b" takes a maximum value and the value on the left side takes a minimum value; while, when the value of "b" becomes small, the value on the left side becomes great.

Figure 6:
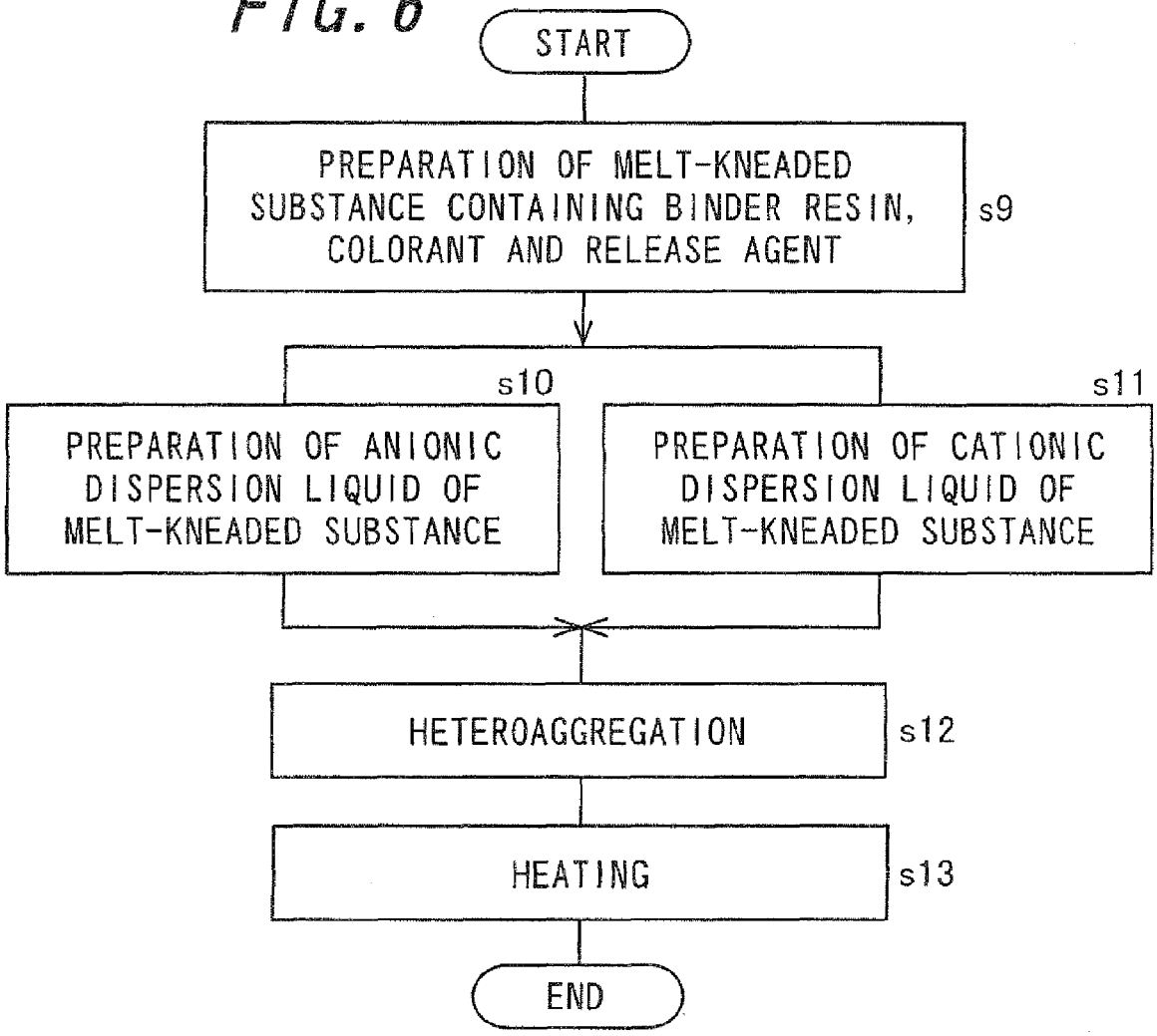
FIG. 6 is a flowchart illustrating a third method of manufacturing a toner according to the invention.

FIG. 6 is a flowchart illustrating a third method of manufacturing a toner according to the invention. In the third method of manufacturing the toner according to the invention, a heating step is further added to the first or second method of manufacturing the toner according to the invention. More specifically, the third method of manufacturing the toner according to the invention includes a step of preparing a melt-kneaded substance containing a binder resin, a colorant and a release agent (Step s9), a step of preparing an anionic dispersion liquid of melt-kneaded substance (Step s10), a step of preparing a cationic dispersion liquid of melt-kneaded substance (Step s11), a heteroaggregation step (Step s12), and a heating step (Step s13).

<Step of Preparing Melt-Kneaded Substance Containing Binder Resin, Colorant and Release Agent (Step s9)>

This step (Step s1) is identical with the step of preparing the melt-kneaded substance containing a binder resin, a colorant and a release agent (Step s1).

<Step of Preparing Anionic Dispersion Liquid of Melt-Kneaded Substance (Step s10)>

This step (Step s10) is identical with the step of preparing the anionic dispersion liquid of melt-kneaded substance (Step s2).

<Step of Preparing Cationic Dispersion Liquid of Melt-Kneaded Substance (Step s11)>

This step (Step s11) is identical with the step of preparing the cationic dispersion liquid of melt-kneaded substance (Step s3).

<Heteroaggregation Step (Step s12)>

This step (Step s12) is identical with the heteroaggregation step (Step s4).

<Heating Step (Step s13)>

In the heating step, the shape of toner is controlled by heating the dispersion liquid. The heating allows extensive control of toner shapes, from spherical to irregular shapes, thereby achieving excellent chargeability, transferability and cleaning properties.

The heating temperature in the heating step is equal to or higher than the glass transition temperature of the binder resin, and that equal to or lower than the softening temperature of the binder resin. By performing granulation in such a temperature range, it becomes possible to control the toner shape extensively, from spherical to irregular shapes, and a toner having the intended shape and excellent transferability and cleaning properties can be obtained.

As a heating method usable herein, there are a method of heating a reaction vessel with electrically-heated wire and a method of heating a reaction vessel by forming a single-layer vacant zone around the reaction vessel and passing steam or hot oil through the vacant zone.

It is advantageous for the heating to be carried out under conditions of dispersing and mixing particles in the reaction vessel while applying shear force to the particles.

When tubing low in flow velocity is heated from outside the tubing, excessively-aggregated particles are deposited on the internal surface of heated areas of tubing. Because many base points on which new excessive aggregates grow are present on complex surfaces of the excessively-aggregated particles, excessive aggregation further progresses and causes the excessively-aggregated particles to grow to lumps, which results in appearance of coarse particles. In order to avoid such a situation, it is preferable that particles are kept in a dispersed state.

When particles show such high viscosity as to cause fusion among themselves in a reaction vessel, application of shear force to the particles makes it possible to prevent coarse particles from appearing through fusion among particles and thereby avoid deterioration in particle size distribution. And the same holds true with regard to a cooling step.

The toner obtained by each of the present first to third methods of manufacturing the toner may undergo modification to its surface properties by addition of external additives. Examples of external additives usable for such a purpose include heretofore known additives, such as silica, titanium oxide, silicone resin, and silica and titanium oxide surface-treated with a silane coupling agent or the like. The amount of external additives used is preferably from 1 part by weight or more and 10 parts by weight or less on the basis of 100 parts by weight of a toner.

The toner obtained by each of the methods according to the invention is free of uneven distribution of colorant and release agent in the toner and contains these ingredients in a state of fine dispersion on a high level, so it has satisfactory fixability, high transparency and high coloring power.

When a toner film, which is in a state of being formed from a toner on a transparent sheet and has a thickness providing a transmittance of 3% at the maximum absorption wavelength in a wavelength range of 400 nm to 700 nm, shows a transmittance of 85% or above at its maximum transmission wavelength, such a toner is high in transparency.

Spectral transmission characteristics of the toner are measured as follows. A color toner containing at least a binder resin and a colorant is put uniformly on a transparent sheet, and kept in an oven set at a temperature 20° to 60° C. higher than the softening point of the binder resin over a specified period of time, and thereby the color toner is fixed onto the transparent sheet and forms a smooth toner film of a thickness L. On the thus formed toner film, spectral transmission characteristic measurements in the wavelength range of 400 nm to 700 nm are made with a typical spectrophotometer (U-3200, trade name, made by Hitachi, Ltd.). As the transparent sheet, transparent sheets for OHP use (referred to as "OHP sheet", hereinafter), such as CX7A4C (item code) made by Sharp Corporation, can be used.

From the thus obtained measurement results of spectral transmission characteristics, the transmittance (%) at the maximum absorption wavelength is determined in the following manner. The measurement results of spectral transmission characteristics of the toner film in the wavelength range of 400 nm to 700 nm are embodied in both a graph drawn by plotting the transmittance T (%) as ordinate and the wavelength (nm) of light as abscissa and a graph drawn by plotting the absorbance as ordinate and the wavelength (nm) of light as abscissa. From the absorbance-plotted graph, the wavelength at with the absorbance shows the maximum value is determined as the maximum absorbance wavelength, and the transmittance (%) at the maximum absorbance wavelength is determined from the graph with transmittance T(%) plotted as ordinate.

With respect to several toner films of different thicknesses, the transmittance T(%) values at the maximum absorption wavelength are determined in the manner mentioned above. The toner film thickness can be chosen arbitrarily from a range of 5 to 20 μm. Prom the data on common logarithms of transmittance (%) values (log T) of toner films of different thicknesses (μm) at the maximum-absorption wavelength, first-order equation of a straight line expressing a correlation between the toner film thickness (μm) and the common logarithm of transmittance value (%) (log T) at the maximum absorption wavelength is calculated by the least-squares approximation.

The transmittance of the toner film having the thickness corresponding to a transmittance of 3% at the maximum absorption wavelength in the equation is determined as follows. From the first-order equation of a straight line calculated by the least-squares approximation, the film thickness corresponding to the transmittance of 3% at the maximum absorption wavelength is calculated. The toner film having the thus calculated thickness is formed on a transparent sheet in the foregoing manner. On the toner film thus formed, spectral transmission characteristics in the wavelength range of 400 nm to 700 nm are measured as mentioned above. The measurement results are embodied in the form of a graph drawn by plotting the transmittance T(%) as ordinate and the wavelength (nm) of light as abscissa. From the graph thus obtained, the wavelength at which the transmittance T shows the maximum value is determined as the maximum transmission wavelength. And the transmittance T at this wavelength is determined as the transmittance (%) at the maximum transmission wavelength.

The present toner can be used as a one-component developer or as one component of a two-component developer. When a toner is used as a one-component developer, only the toner is used without carrier, and frictionally electrified with a blade and a fur brush in a developing sleeve. Thus, the toner is fixed onto the sleeve and carried, and thereby made available for image formation.

When the present toner is used as one component of a two-component developer, it is used in combination with a carrier. As the carrier, hitherto known carriers can be used. Examples of a carrier usable in combination with the present toner include simple or complex ferrites containing iron, copper, zinc, nickel, cobalt, manganese, chromium or the like, and carrier core particles surface-coated with a coating material. As the coating material, hitherto known materials can be used, with examples including polytetrafluoroethylene, monochlorotrifluoroethylene polymer, polyvinylidene fluoride, silicone resins, polyester resins, metal compounds of di-tert-butylsalicylic acid, styrene resins, acrylic resins, polyamide, polyvinylbutyral, Nigrosine, aminoacrylate resins, basic dyes, lakes of basic dyes, silica fine powder and alumina fine powder. It is advantageous for the coating material to be chosen according to the toner component. Additionally, those coating materials may be used alone, or two or more kinds of them may be used in combination.

Alternatively, resin-coated carriers prepared by coating magnetic particles with resin or resin-dispersed carriers prepared by dispersing magnetic particles into resin may be used. The resin with which magnetic particles are coated has no particular restriction, and examples thereof include olefin resins, styrene resins, styrene/acrylic resins, silicone resins, ester resins and fluorine-containing-polymer-based resins. And the resin used for resin-dispersed carrier has no particular restriction, and examples of thereof include styrene/acrylic resins, polyester resins, fluorine resins and phenol resins.

The carrier preferably has a spherical or flat shape. The volume average particle size of carrier is preferably 10 μm or more and 100 μm or less, and far preferably 20 μm or more and 50 μm or less. The resistivity of carrier is preferably $10^8$ Ω·cm or above, and far preferably $10^{12}$ Ω·cm or above. The carrier's resistivity is a value obtained by reading the current value under application of a voltage that, when a load of 1 kg/cm$^2$ is imposed on the carrier put in a vessel having a cross-sectional area of 0.50 cm$^2$ and crammed in the vessel by tapping, generates an electric field of 1,000 V/cm between, the load and a bottom electrode. The low resistivity allows injection of charge into carrier when a bias voltage is applied to the developing sleeve, and thereby adhesion of carrier particles to a photoreceptor becomes ease. In addition, breakdown of the bias voltage tends to occur.

The magnetization intensity (maximum magnetization) of a carrier used is preferably from 10 to 60 emu/g, and far preferably from 15 to 40 emu/g. Depending on the magnetic flux density of a developing roller used, the carrier having magnetization intensity lower than 10 emu/g suffers from no magnetic constraints under magnetic flux density conditions of commonly used developing rollers, so there is a fear of carrier scattering. On the other hand, when the magnetization intensity is increased beyond 60 emu/g, carrier ears grow to excessive heights; as a result, image carriers becomes difficult to keep the non-contact state in the case of non-contact development, while in the case of contact development there is a fear that the toner image obtained tends to bear sweep marks.

The usage ratio between the toner and the carrier in a two-component developer has no particular limitations, and can be chosen properly according to the toner and carrier used. However, it is appropriate in the case of, e.g., a resin-coated carrier (density: 5 to 8 g/cm$^2$) that the toner be used in a proportion of 2 to 30% by weight, and preferably 2 to 20% by weight, with respect to the total weight of the developer. In addition, the coverage of a carrier with a toner in the case of a two-component developer is preferably from 40 to 80%.

Figure 7:
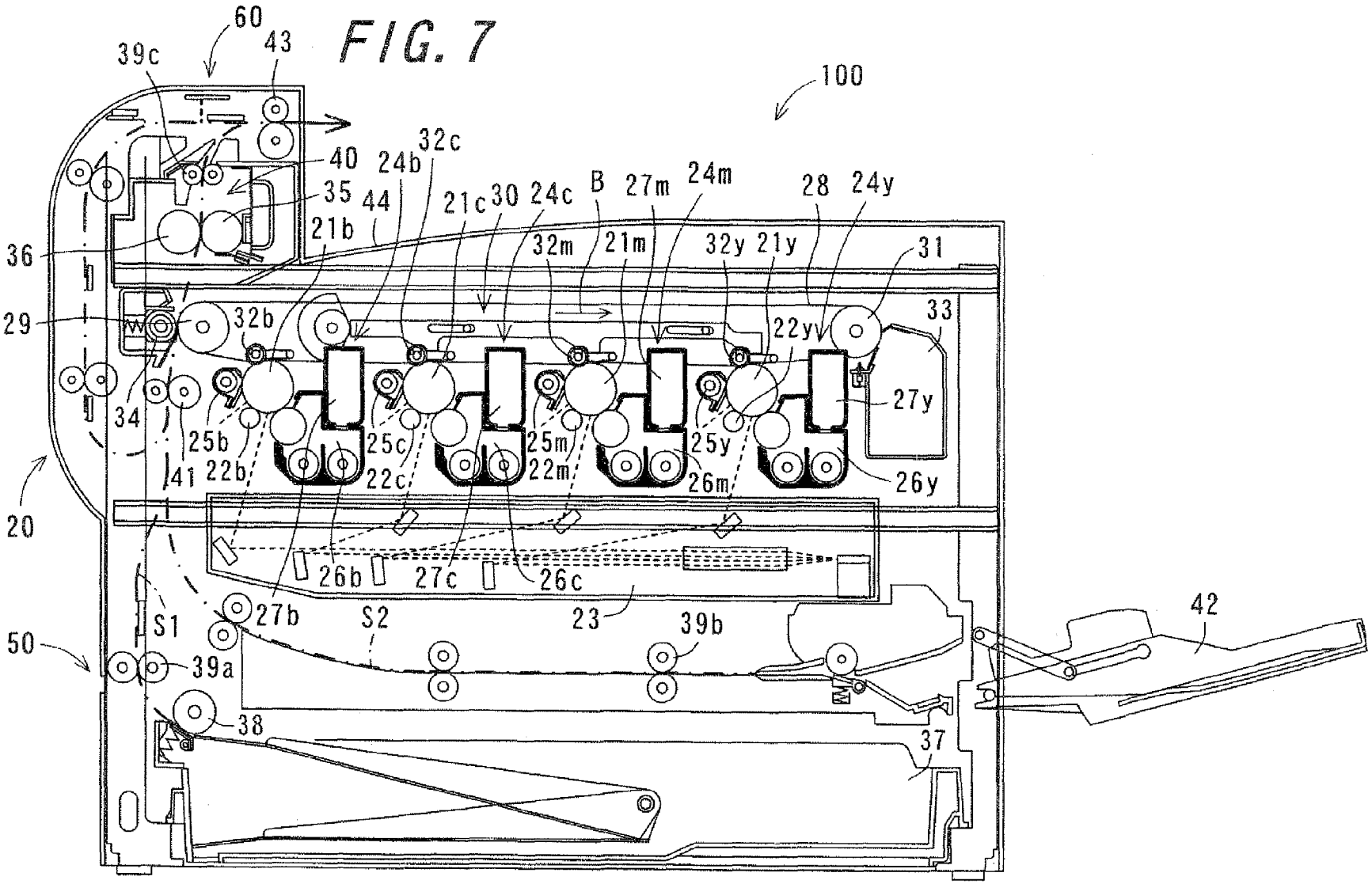
FIG. 7 is a cross-sectional view illustrating schematically an example of configuration of image forming apparatus suitable for use by a toner according to the invention.

FIG. 7 is a cross-sectional view illustrating schematically an example of configuration of image forming apparatus 100 suitable for use by the toner according to the invention. The image forming apparatus 100 is a multifunction printer into which the functions of a copier, a printer and a facsimile are combined, and forms full-color or monochrome images on recording media in accordance with transmitted image information. In other words, the image forming apparatus has three printing modes, namely a copier mode (copying mode), a printer mode and a FAX mode, and a choice of the three printing modes is made through a control section (not shown), in response to the inputting of an operating instruction from the operating section (not shown) or printing job reception or the like from a personal computer, a mobile terminal device, an information record-and-storage medium or an external apparatus with a memory device. The image forming apparatus 100 includes a toner image forming section 20, a transfer section 30, a fixing section 40, a recording medium feeding section 50, and a discharging section 60. All members included in the toner image forming section 20 and some members included in the transfer section 30 are each provided in a group of four in order to respond to image information about individual colors, black (b), cyan (c), magenta (m) and yellow (y), included in color image information. Herein, distinctions among every member in a group of four which are provided for four colors are drawn by adding alphabetic letters symbolizing the four colors, b, c, m and y, to the end of corresponding reference numeral. On the other hand, the members called generically are denoted by reference numerals alone.

The toner image forming section 20 includes a photoreceptor drum 21, a charging section 22, an exposure unit 23, a developing device 24 and a cleaning unit 25. The charging section 22, the developing device 24 and the cleaning unit 25 are arranged around the photoreceptor drum 21 in the order of mention. The position at which the charging section 22 is placed is vertically below the positions of developing device 24 and the cleaning unit 25.

The photoreceptor drum 21 is supported by a drive section (not shown) allowing a rotary drive on the drum's axis, and this drum is a latent image carrier including a conductive substrate and a photosensitive layer formed on the conductive substrate surface (not shown). The conductive substrate may be various in shape, and it can assume the shape of, e.g., a cylinder, a column or a thin sheet. Of these shapes, a cylindrical shape is preferable to the others. The conductive substrate is formed from a conductive material. Examples of such a conductive material include those commonly used in this field, such as metals including aluminum, copper, brass, zinc, nickel, stainless steel, chromium, molybdenum, vanadium, indium, titanium, gold and platinum, alloys produced from two or more of the metals recited above, conductive film obtained by forming on a film-like base, such as synthetic resin film, metal film, or paper, a conductive layer made up of one or more than one substance chosen from aluminum, aluminum alloys, tin oxide, gold or indium oxide, and a resin composition containing at least either conductive particles or conductive polymer. Additionally, the film-like base used in the conductive film is preferably synthetic resin film, especially polyester film. Moreover, formation of the conductive layer for the conductive film is preferably carried out by vapor deposition, coating or so on.

The photosensitive layer is formed by lamination of a charge generating layer containing a charge generating substance and a charge transporting layer containing a charge transporting substance. Herein, it is preferable that an undercoat layer is formed between the conductive substrate and the charge generating layer or the charge transporting layer. Formation of an undercoat layer can offer advantages that the undercoat layer covers flaws and unevenness present on the conductive substrate surface and smoothes a surface of the photosensitive layer, and further allows prevention of degradation in changeability of the photosensitive layer under repeated use and improvement in changeability of the photosensitive layer in at least either low-temperature or low-humidity surroundings. Furthermore, the photosensitive layer may be a laminated photosensitive layer of a three-layer structure which has as the topmost layer a protective layer for protecting the photosensitive layer surface and thereby excels in durability.

The charge generating layer contains as a main component a charge generating substance which can generate electric charge by irradiation with light, and further contains known ingredients, such as a binder resin, a plasticizer and a sensitizer, as required. As the charge generating substance, those commonly used in this field are usable, with examples including perylene pigments, such as peryleneimide and perylenic acid anhydride; polycyclic quinone pigments, such as quinacridone and anthraquinone; phthalocyanine pigments, such as metal and metal-free phthalocyanines, and halogenated metal-free phthalocyanines; squarylium dyes; azulenium dyes; thiapyrylium dyes; and azo pigments having a carbazole skeleton, a styrylstilbene skeleton, a triphenylamine skeleton, a dibenzothiophene skeleton, an oxadiazole skeleton, a fluorenone skeleton, a bisstilbene skeleton, a distyryloxadiazole skeleton and a distyrylcarbazole skeleton respectively. Of these pigments, metal-free phthalocyanine pigment, oxotitanylphthalocyanine pigment, bisazo pigment containing at least either a fluorene ring or a fluorenone ring, and bisazo and trisazo pigments derived from aromatic amines have higher ability to generate electric charge, and they are suitable for formation of a highly sensitive photosensitive layer. These charge generating substances can be used alone, or two or more kinds of them may be used in combination. The content of charge generating substance, though it has no particular limitations, is preferably from 5 to 500 parts by weight, and far preferably from 10 to 200 parts by weight, on the basis of 100 parts by weight of binder resin in the charge generating layer. As the binder resin for use in the charge generating layer, commonly used resins in this field are usable, with examples including melamine resin, epoxy resin, silicone resin, polyurethane, acrylic resin, vinyl chloride-vinyl acetate copolymer resin, polycarbonate, phenoxy resin, polyvinyl butyral, polyarylate, polyamide and polyester. These binder resins may be used alone, or two or more kinds of them may be used in combination, if needed.

The charge generating layer can be formed in the following manner. A charge generating layer coating solution is prepared by dissolving or dispersing a charge generating substance and a binder resin, and further a plasticizer, a sensitizer and so on as required, in individually appropriate amounts into a proper solvent capable of dissolving or dispersing these ingredients, and then applied to the conductive substrate surface and dried, thereby forming the charge generating layer. The thus formed charge generating layer has no particular restriction as to its thickness, but the thickness thereof is preferably from 0.05 to 5 μm, and far preferably from 0.1 to 2.5 μm.

The charge transporting layer stacked on the charge generating layer contains as essential components a charge transporting substance having an ability to accept electric charge generated from a charge generating substance and transport the electric charge and a binder resin suitable for the charge transporting substance, and may further contain known additives including an antioxidant, a plasticizer and a sensitizer as required. As the charge transporting substance, those commonly used in this field are usable, with examples including electron-donating substances, such as poly-N-vinylcarbazole and derivatives thereof, poly-γ-carbazolylethylglutamate and derivatives thereof, pyrene-formaldehyde condensate and derivatives thereof, polyvinylpyrene, polyvinylphenanthrene, oxazole derivatives, oxadiazole derivatives, imidazole derivatives, 9-(p-diethylaminostyryl)anthracene, 1,1-bis(4-dibenzylaminophenyl)propane, styrylanthracene, styrylpyrazoline, pyrazoline derivatives, phenylhydrazones, hydrazone derivatives, triphenylamine compounds, tetraphenyldiamine compounds, triphenylmethane compounds, stilbene compounds and azine compounds having a 3-methyl-2-benzothiazoline ring; and electron-accepting substances, such as fluorenone derivatives, dibenzothiophene derivatives, indenothiophene derivatives, phenanthrenequinone derivatives, indenopyridine derivatives, thioxanthone derivatives, benzo[c]cinnoline derivatives, phenazine oxide derivatives, tetracyanoethylene, tetracyanoquinodimethane, promanil, chloranil and benzoquinone. These charge transporting substances may be used alone, or two or more kinds of them may be used in combination. The content of charge transporting substance, though it has no particular limitations, is preferably from 10 to 300 parts by weight, and far preferably from 30 to 150 parts by weight, on the basis of 100 parts by weight of binder resin in the charge transporting layer. As the binder resin for use in the charge transporting layer, commonly used resins in this field are usable, with examples including polycarbonate, polyarylate, polyvinyl butyral, polyamide, polyester, polyketone, epoxy resin, polyurethane, polyvinyl ketone, polystyrene, polyacrylamide, phenol resin, phenoxy resin, polysulfone resin, and copolymer resins thereof. Of these polymers, polycarbonate, containing bisphenol Z as a monomer constituent (hereinafter described as "bisphenol Z-type polycarbonate") and a mixture of bisphenol Z-type polycarbonate and another polycarbonate are preferred over the others in consideration of film formability, abrasion resistance of the charge transporting layer formed and electrical characteristics. Those binder resins may be used alone, or two or more kinds of them may be used in combination.

The charge transporting layer preferably contains an antioxidant in combination with a charge transporting substance and a binder resin suitable for use therein. As the antioxidant, those commonly used in this field are usable, with examples including vitamin E, hydroquinone, hindered amine, hindered phenol, paraphenylenediamine, arylalkane and derivatives thereof, organosulfur compounds and organophosphorus compounds. These antioxidants may be used alone, or two or more kinds of them may be used in combination. The antioxidant content, though not particularly limited, is preferably from 0.01 to 10% by weight, and far preferably from 0.05 to 5% by weight, based on the total ingredients constituting the charge transporting layer. The charge transporting layer can be formed as follows: A charge transporting layer coating solution is prepared by dissolving or dispersing a charge transporting substance and a binder resin, and further an antioxidant, a plasticizer, a sensitizer and so on as required, in individually appropriate amounts into a proper solvent capable of dissolving or dispersing these ingredients, and then applied to the charge generating layer surface and dried, thereby forming the charge transporting layer. The thus formed charge transporting layer has no particular restriction as to its thickness, but the thickness thereof is preferably from 10 to 50 μm, and far preferably from 15 to 40 μm. Alternatively, it is also possible to form a photosensitive layer in which both a charge generating substance and a charge transporting substance are present. This case and the case of forming a charge generating layer and a charge transporting layer independently may be alike in kinds and contents of charge generating substance and charge transporting substance, binder resin and additives.

In embodiments of the invention, though a photoreceptor drum having on the surface an organic photosensitive layer using the charge generating substance and the charge transporting substance as recited above is used, an alternative photoreceptive drum having on the surface an inorganic photosensitive layer using silicon or the like can be used.

The charging section 22 is placed so that it faces the photoreceptor drum 21 along the length direction of the photoreceptor drum 21 in a state of leaving a narrow space on the surface of the photoreceptor drum 21, and electrifies the surface of photoreceptor drum 21 so that the photoreceptor comes to have the intended polarity and potential. In the charging section 22, a charging brush-type charging device, a charger-type charging device, a pin array charging device, an ion generator or soon can be used. Although the charging section 22 is placed so as to part from the surface of photoreceptor drum 21 in the foregoing mode for carrying out the invention, there is no restriction as to the way to place the charging section 22. For example, when a charging roller is used in the charging section 22, the charging roller may be placed in pressure-contact with the photoreceptor drum 21, or a contact charging type charger, such as a charging brush or magnetic brush, may be used.

The exposure unit 23 is placed so that light beams corresponding to information for respective colors emitted from the exposure unit 23 passes between the charging section 22 and the developing device 24, and illuminates the surface of the photoreceptor drum 21. In the exposure unit 23, image information is converted into light beams corresponding to information for the respective colors of black (b), cyan (c), magenta (m) and yellow (y), and the surface of photoreceptor drum 21 charged uniformly to an intended potential with the charging section 22 is exposed to a light beam corresponding to information for each color and thereby an electrostatic latent image is formed thereon. As the exposure unit 23, a laser irradiation unit and a laser scanning unit having a plurality of reflection mirrors may be used in combination. Alternatively, a unit into which LED arrays, liquid crystal shutters and a light source are combined as appropriate may be used.

Figure 8:
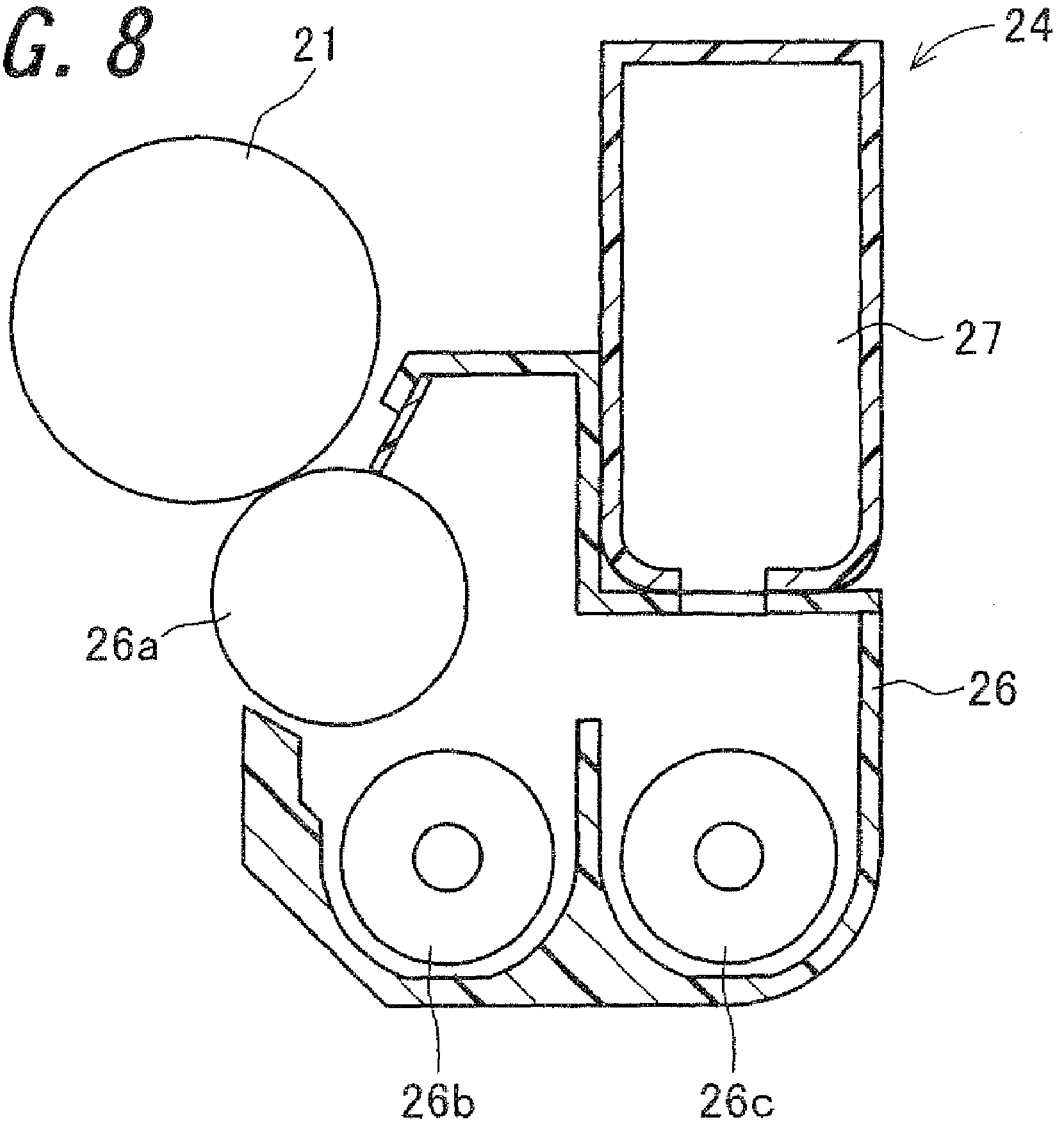
FIG. 8 is a cross-sectional view illustrating schematically one example of the makeup of a developing device.

FIG. 8 is a cross-sectional view illustrating schematically one example of the makeup of a developing device 24. The developing device 24 includes a developing tank 26 and a toner hopper 27. The developing tank 26 is a container-shaped member that is placed so as to face the surface of the photoreceptor drum 21 and feeds a toner to electrostatic latent images formed on the surface of the photoreceptor drum 21, thereby developing the latent images and forming toner images as visible images. The developing tank 26 accommodates in its internal space not only a toner but also roller members, such as a developing roller 26*a*, a feeding roller 26*b* and a stirring roller 26*c*, and a screw member, and rotatably supports these members. The developing tank 26 has an opening formed in its side wall facing the photoreceptor drum 21 and, via this opening, the developing roller 26*a* is installed at the position opposite the photoreceptor drum 21 in a state of being capable of rotary drive. The developing roller 26*a* is a roller-shaped member that allows a toner feeding to electrostatic latent images on the surface of the photoreceptor drum 21 at the point of pressure-contact with or the closest approach to the photoreceptor drum 21. To the surface of the developing roller 26*a* at toner-feeding time, a potential opposite in polarity to the potential of charged toner is applied as developing bias potential. Application of the developing bias allows smooth feeding of the toner on the surface of the developing roller 26*a* to electrostatic latent images. And by changing the developing bias voltage value, the amount of toner fed to an electrostatic latent image (the amount of toner attached) can be controlled. The feeding roller 26*b* is a roller-shaped member installed at a position facing the developing roller 26*a* in a state of being capable of rotary drive, and feeds a toner to the periphery of the developing roller 26*a*. The stirring roller 26*c* is a roller-shaped member installed at a position facing the feeding roller 26*b* in a state of being capable of rotary drive, and feeds a toner, which is newly fed from the toner hopper 27 into the developing tank 26, to the periphery of the feeding roller 26*b*. The toner hopper 27 is mounted so that its toner replenishing mouth (not shown) vertically attached at the bottom is communicated with a toner receiving port (not shown) vertically attached to the upper part of the developing tank 26, and replenishes the developing tank 26 with a toner according to the condition of toner consumption. Alternatively, a structure that replenishment of a toner is carried out directly from toner cartridges of various colors may be adopted instead of using the toner hopper 27.

The cleaning unit 25 removes a toner remaining on the surface of the photoreceptor drum 21 after transfer of toner images onto a recording medium and cleans up the surface of the photoreceptor drum 21. In the cleaning unit 25, a plate-shaped member, such as a cleaning blade, is used. Making an additional remark, since the present image forming apparatus mainly uses an organic photoreceptor drum as the photoreceptor drum 21 and a resinous ingredient predominates in the surface part of the organic photoreceptor drum, deterioration of the drum surface tends to progress through chemical reaction of ozone evolved by corona discharge in the charging section 22. However, the deteriorated surface part wears from chafing action by the cleaning unit 25 and is removed slowly but surely. Therefore, the problem of surface degradation from ozone is resolved actually, and the charged potential by charging operation can be kept with stability over a long period. Although the cleaning unit 25 is provided in this mode for carrying out the invention, there is no restriction as to cleaning. In some cases, the cleaning unit 25 needn't be provided.

In the toner image forming section 20, the surface of the photoreceptor drum 21 in a state of being charged uniformly by the charging section 22 is irradiated with light carrying signals responsive to image information, which is emitted from the exposure unit 23, and thereby electrostatic latent images are formed on the drum surface. To the electrostatic latent images, a toner is fed from the developing device 24 to form toner images. The toner images are transferred to an intermediate transfer belt 28, and then the toner remaining on the surface of the photoreceptor drum 21 is removed with the cleaning unit 25. This series of image-forming operations is carried out repeatedly.

The transfer section 30 is placed over the photoreceptor drum 21, and includes an intermediate transfer belt 28, a drive roller 29, a driven roller 31, intermediate transfer rollers 32*b*, 32*c*, 32*m* and 32*y*, a transfer belt cleaning unit 33 and a transfer roller 34. The intermediate transfer belt 28 is a endless belt-form member that is stretched between the drive roller 29 and the driven roller 31 to form a loop-shaped traveling pathway, and it is driven rotatively so that a face of the belt abutting on the photoreceptor drum 21 travels in the direction shown by an arrow B, namely the direction toward the photoreceptor drum 21*b* from the photoreceptor drum 21 *y*.

When the intermediate transfer belt 28 passes by the photoreceptor drum 21 while coming into contact with the photoreceptor drum 21, a transfer bias voltage opposite in polarity to the charged toner on the surface of the photoreceptor drum 21 is applied by means of the intermediate transfer roller 32 placed so that the transfer roller 32 and the photoreceptor drum 21 face each other across the intermediate transfer belt 28, and thereby the toner images formed on the surface of the photoreceptor drum 21 are transferred onto the intermediate transfer belt 28. In the case of full-color images, toner images of four colors formed on the four photoreceptor drums 21*y*, 21*m*, 21*c* and 21*b* sequentially are transferred and overlaid onto the intermediate transfer belt 28, thereby forming full-color toner images. The drive roller 29 is provided in a state of being capable of rotating on its axis by means of a drive section (not shown), and its rotary drive allows the rotation of the intermediate transfer belt 28 in the direction of the arrow B. The driven roller 31 is provided in a state that its rotation can follow the rotary drive of the drive roller 29 and it gives a steady tension to the intermediate transfer belt 28 in order to avoid loosening of the intermediate transfer belt 28. The intermediate transfer roller 32 is provided in a state of being in pressure-contact with the photoreceptor drum 21 via the intermediate transfer belt 28, and that capable of a rotary drive on its axis by means of a drive, section (not shown). The intermediate transfer roller 32, to which the power supply (not shown) for application of the transfer bias voltage is connected, functions to transfer the toner images on the photoreceptor drum 21 onto the intermediate transfer belt 28. The transfer belt cleaning unit 33 is provided in a state of facing the driven roller 31 via the intermediate transfer belt 28 and being contact with the outer surface of the intermediate transfer belt 28. A toner adhering to the intermediate transfer belt 28 through contact between the photoreceptor drum 21 and the intermediate transfer belt 28 and remaining on the intermediate transfer belt 28 without undergoing transfer to a recording medium becomes a cause of stains on the back of a recording medium, so the toner remaining on the surface of the intermediate transfer belt 28 is removed and recovered by means of the transfer belt cleaning unit 33. The transfer roller 34 is provided in a state of being in pressure-contact with the drive roller 29 via the intermediate transfer belt 28, and that capable of a rotary drive on its axis by means of a drive section (not shown). In the pressure-contacting portion (transfer nip portion) between the transfer roller 34 and the drive roller 29, the toner images carried on the intermediate transfer belt 28 and transported thereto are transferred to a recording medium fed from a recording medium feeding section 50 mentioned below. The recording medium bearing toner images is fed to the fixing section 40. According to the transfer section 30, the toner images transferred from the photoreceptor drum 21 to the intermediate transfer belt 28 in the pressure-contacting portion between the photoreceptor drum 21 and the intermediate transfer roller 32 are transported into the transfer nip portion by the rotary drive of the intermediate transfer belt 32 in the direction of the arrow B, and transferred onto a recording medium in that nip portion.

The fixing section 40 is placed on a side of downstream in a recording medium conveying direction from the transfer section 30, and includes a fixing roller 35 and a pressure roller 36. The fixing roller 35 is provided in a state of being capable of a rotary drive by means of a drive section (not shown), and heats the toner forming unfixed toner images carried on a recording medium and fuses it, thereby fixing the toner images to the recording medium. A heating section (not shown) is provided in the interior of the fixing roller 35. The heating section heats the fixing roller 35 so that the surface of the fixing roller 35 reaches a designated temperature. In the heating section, a heater, a halogen lamp or the like can be used. The heating section is controlled by a fixing-condition control section described later. A temperature-detection sensor is installed in the proximity of the surface of the fixing roller 35, and detects the surface temperature of the fixing roller 35. Results of detection by the temperature-detection sensor are written into a memory portion of a control unit described later. The fixing-condition control section controls the operation of the heating section. The pressure roller 36 is placed in a state of being in pressure-contact with the fixing roller 35, and supported in a state that its rotation can follow the rotary drive of the fixing roller 35. The pressure roller 36 assists the toner images to be fixed to a recording medium by pressing the toner against the recording medium at the time of fusing the toner by the fixing roller 35 and fixing it to the recording medium. The pressure-contacting portion between the fixing roller 35 and the pressure roller 36 is a fixing nip portion. According to the fixing section 40, the recording medium carrying toner images transferred in the transfer section 30 is caught between the fixing roller 35 and the pressure roller 36 and passed through the fixing nip portion, and at this passing the toner images are fixed to the recording medium by being pressed against the recording medium under heating. Thus, image formation is effected.

The recording medium feeding section 50 includes an automatic paper feed tray 37, a pickup roller 38, conveying rollers 39*a* and 39*b*, registration rollers 41 and a manual paper feed tray 42. The automatic paper feed tray 37 is placed in the vertically lower part of the image forming apparatus 100, and this tray is a receptacle-shaped member storing recording mediums. Examples of recording mediums include plain paper, color copy paper, sheets for overhead projector use, and postcards. The pickup roller 38 picks up the recording mediums stored in the automatic paper feed tray 37 one by one, and feeds each recording medium picked up to a paper conveyance path S1. The conveying rollers 39*a* are a pair of roller members provided in pressure-contact with each other, and conveys the recording medium to the registration rollers 41. The registration rollers 41 are a pair of roller members provided in pressure-contact with each other, and feeds the recording medium fed from the conveying rollers 39*a* into the transfer nip portion in synchronization with conveying of the toner images borne on the intermediate transfer belt 28 into the transfer nip portion. The manual paper feed tray 42 is a device storing recording mediums which are different from the recording media stored in the automatic paper feed tray 37 and may have any size and which are to be taken into the image forming apparatus, and the recording medium taken in from the manual paper feed tray 42 is made to pass through a paper conveyance path S2 by means of the conveying rollers 39*b* and fed to the registration rollers 41. According to the recording medium feeding section 50, the recording mediums fed one by one from the automatic paper feed tray 37 or the manual paper feed tray 42 are fed to the transfer nip portion in synchronization with the conveying of toner images borne on the intermediate transfer belt 28 into the transfer nip portion.

The discharging section 60 includes conveying rollers 39*c*, discharging rollers 43 and a catch tray 44. The conveying rollers 39*c* are placed on a side of downstream in the paper conveying direction from the fixing nip portion, and conveys the recording medium to which images are fixed by the fixing section 40 to the ejection roller 43. The discharging rollers 43 discharge the image-fixed recording medium onto the catch tray 44 provided on the vertically top side of the image forming apparatus 100. The catch tray 44 stores image-fixed recording mediums.

The image forming apparatus 100 include a control unit (not shown). The control unit is provided, e.g., in the upper part of the internal space of the image forming apparatus 100, and includes a memory portion, a computing portion and a control portion. Into the memory portion of the control unit are inputted various set values via an operating panel (not shown) placed on the top side of the image forming apparatus 100, results of detection by sensors (not shown) placed at various sites in the interior of the image forming apparatus 100, image information from external apparatuses, and so on. In addition, programs for executing various functional elements are written into the memory portion. Herein, the various functional elements include a recording medium judgment section, an adhesion quantity control section, and a fixing condition control section. In the memory portion, memories used commonly in this field can be used, with examples including read-only memory (ROM), random-access memory (RAM) and a hard disk drive (HDD). The external apparatuses usable herein include electric and electronic apparatuses which allow formation and capture of image information and are electrically connectable to the image forming apparatus. Examples of such apparatuses include a personal computer, a digital camera, a television receiver, a video recorder, a DVD (Digital Versatile Disc) recorder, HDDVD (High-Definition Digital Versatile Disc), a Blu-ray Disc recorder, a facsimile, and a mobile terminal. The computing portion retrieves various kinds of data (such as statements to form images, results of detection and image information) written into the memory portion and programs of the various functional elements, and makes various decisions. The control portion transmits control signals to applicable units according to the results of decisions made by the computing portion, and exercises control over operations of the units. Both the control portion and the computing portion include processing circuitry implemented by a microcomputer or a microprocessor equipped with CPU (Central Processing Unit). In addition to the processing circuitry, the control unit includes a main power source, and this power source supplies electricity to not only the control unit but also various units installed in the interior of the image forming apparatus 100.

When images are formed by using the toner, two-component developer, developing device and image forming apparatus according to the invention, the images formed can have high density and high quality.

EXAMPLES

The invention will now be illustrated in more detail by reference to the following examples and comparative examples. However, the invention should not be construed as being limited to these examples, and has no particular restrictions on changes and modifications so long as they do not depart from the spirit and scope of the invention. In the following, all parts and percentages (%) are by weight unless otherwise indicated.

Glass transition temperatures and softening temperatures of binder resins used in the following examples and the comparative examples are measured according to the methods mentioned below.

<Volume Average Particle Sizes of Release Agent and Melt-Kneaded Substance>

Particle size distribution measurement is made on sample particles by means of a measuring apparatus (Microtrac Particle Size Analyzer 9320HRA (X-100), trade name, made by Nikkiso Co., Ltd.), and a volume average particle size is determined from the volume particle size distribution of the sample particles.

<Release Agent Content>

A differential scanning calorimetric analysis is made on 1 gram of a release agent, and the area A1 of the fusion peak of the release agent is determined from the DSC curve obtained. In addition, a differential scanning calorimetric analysis is made on 1 g of toner particles, and from the DSC curve obtained is determined the area A2 of the fusion peak corresponding to the fusion peak of the release agent. Based on the following expression (6), the release agent content W1 (%) in the toner particles is calculated from the measurement results.

$$W1=(A2/A1)\times 100 \quad (6)$$

<Glass Transition Temperature (Tg) of Binder Resin>

In conformance with Japanese Industrial Standards (JIS) K7121-1987, 1 g of a sample is heated at a temperature rising rate of 10° C./min and its DSC curve is taken on a differential scanning calorimeter (DSC220, trade name, made by Seiko Instruments & Electronics Ltd.). The temperature corresponding to a point of intersection of two lines, namely a straight line obtained by extending the high-temperature-side base line of the endothermic peak on the DSC curve obtained, which corresponds to glass transition, to the low temperature side and a tangent line drawn at the point providing the maximum slope on the curve in a range from the rising edge to the top of the peak, is determined as the glass transition temperature (Tg).

<Softening Temperature (Tm) of Binder Resin>

By use of instrument for evaluating rheological properties (Flow Tester CFT-100C, tradename, made by Shimadzu Corporation), 1 g of a sample is heated at a temperature-rising rate of 6° C./min as a load of 10 kgf/cm$^2$ ($9.8\times10^5$ Pa) is imposed on the sample so as to extrude the sample from a die (nozzle), and the temperature at which one-half the sample comes to flow out is determined as the softening temperature. The die used herein is a die having an aperture diameter of 1 mm and a length of 1 mm.

<Melting Point of Release Agent>

By using a differential scanning calorimeter (DSC220, trade name, made by Seiko Instruments & Electronics Ltd.), an operation that 1 g of a release agent sample is heated up to 150° C. from 20° C. at a temperature rising rate of 10° C./min, and then rapidly cooled down to 20° C. from 150° C. is repeated twice and DSC curves are taken. The temperature at the top of the endothermic peak corresponding to melting on the DSC curve taken under the second operation is determined as the melting point of the release agent.

Example 1

| <Preparation of Melt-kneaded Substance Containing Binder Resin, Colorant and Release Agent> | |
|---|---|
| Polyester (binder resin, FC1469, trade name, manufactured by Mitsubishi Rayon Co., Ltd.; glass transition temperature: 60° C.; softening temperature: 110° C.): | 82.0 parts |
| Charge control agent (N5P, trade name, manufactured by Clariant in Japan): | 2.0 parts |
| Polyethylene wax (release agent, HNP-10, trade name, manufactured by Nippon Seiro Co., Ltd.; melting point: 85° C.): | 7.5 parts |
| Colorant (KET. BLUE111, manufactured by DIC Corporation): | 8.5 parts |

These ingredients were premixed by means of HENSCHEL MIXER (trade name, made by Mitsui Mining Co., Ltd.), and the mixed powder obtained was melt-kneaded with an open-roll machine (MOS 140-800, trade name, made by Mitsui Mining Co., Ltd.). Thus, a melt-kneaded substance was obtained.

| <Preparation of Anionic Dispersion Liquid of Melt-kneaded Substance> | |
|---|---|
| Melt-kneaded substance: | 400 parts |
| Ion-exchanged water: | 1,424 parts |

These ingredients were pulverized at 3,000 rpm for 5 minutes by means of a colloid mill (PUC COLLOID MILL, trade name, made by NIPPON BALL VALVE CO., LTD.). Then, the following ingredients were added to the pulverized matter, and subjected to 5-minute processing for formulation by using Foamless Mixer (trade name, made by Beryu Co., Ltd.) at 3,000 rpm. Thus, kneaded substance slurry was obtained.

| | |
|---|---|
| Polyacrylic acid (anionic dispersant, DISROL H-14-N, trade name, manufactured by Nippon Nyukazai Co., Ltd.): | 133 parts |
| Airrol (surfactanct, Airrol CT-1p, trade name, manufactured by TOHO Chemical Industry Co., Ltd.): | 2.4 parts |
| Xanthan gum (thickener): | 40 parts |

The polyacrylic acid used herein is an anionic dispersant that contains a polymer having a main chain to which anionic polar groups are attached.

Next, the kneaded substance slurry was pretreated by being put into NANO3000 (trade name, made by Beryu Co., Ltd.) and passed twice through there under 50 MPa at room temperature. Further, the pretreated matter was made finer under 167 MPa at 150° C., thereby preparing an anionic dispersion liquid of melt-kneaded substance.

<Preparation of Cationic Dispersion Liquid of Melt-Kneaded Substance>

A cationic dispersion liquid of melt-kneaded substance was prepared in the same manner as the anionic dispersion liquid of melt-kneaded substance, except that the polyacrylic acid (anionic dispersant, DISROL H-14-N, trade name, manufactured by Nippon Nyukazai Co., Ltd.) used in the preparation of the anionic dispersion liquid of melt-kneaded substance was changed to alkyldimethylbenzylammonium chloride (cationic dispersant, SANIZOL B-50, manufactured by Kao Corporation).

<Heteroaggregation>

A 300 parts portion of the anionic dispersion liquid of melt-kneaded substance and a 300 parts portion of the cationic dispersion liquid of melt-kneaded substance were mixed, and thereto 3 parts of sodium chloride was added. The resultant mixture was stirred at 10,000 rpm for 30 minutes at 80° C. by means of CREAMIX (trade name, made by M TECHNIQUE Co., LTD.), and thereby heteroaggregation was caused. Thus, the toner of Example 1 was obtained.

Example 2

| <Preparation of Melt-kneaded Substance Containing Binder Resin and Colorant> | |
|---|---|
| Polyester (binder resin, FC1469, trade name, manufactured by Mitsubishi Rayon Co., Ltd.; glass transition temperature: 60° C.; softening temperature: 110° C.): | 82.0 parts |
| Charge control agent (N5P, trade name, manufactured by Clariant in Japan): | 2.0 parts |
| Colorant (KET. BLUE111, manufactured by DIC Corporation): | 8.5 parts |

These ingredients were premixed by means of HENSCHEL MIXER (trade name, made by Mitsui Mining Co., Ltd.), and the mixed powder obtained was melt-kneaded with an open-roll machine (MOS 140-800, trade name, made by Mitsui Mining Co., Ltd.). Thus, a melt-kneaded substance was obtained.

<Preparation of Anionic Dispersion Liquid of Melt-Kneaded Substance>

An anionic dispersion liquid of melt-kneaded substance was prepared in the same manner as the anionic dispersion liquid of melt-kneaded substance prepared in Example 1, except that the melt-kneaded substance prepared in Example 1 was changed to the melt-kneaded substance prepared in Example 2.

| <Preparation of Cationic Dispersion Liquid of Release Agent> | |
|---|---|
| Polyethylene wax (release agent, HNP-10, trade name, manufactured by Nippon Seiro Co., Ltd.; melting point: 85° C.): | 180 parts |
| Alkyldimethylbenzylammonium chloride (cationic dispersant, Sanizol B-50, manufactured by Kao Corporation): | 60 parts |
| Ion-exchanged water | 360 parts |

These ingredients were put into CREAMIX (trade name, made by M TECHNIQUE Co., LTD.) and stirred at 8,000 rpm for 10 minutes at 80° C., thereby preparing a cationic dispersion of release agent.

| <Heteroaggregation> | |
|---|---|
| Anionic dispersion liquid of melt-kneaded substance: | 571.4 parts |
| Cationic dispersion liquid of release agent: | 28.6 parts |
| Sodium chloride: | 6.0 parts |

These ingredients were put into CREAMIX (trade name, made by M TECHNIQUE Co., LTD.), provided that the cationic dispersion liquid of release agent was put before the anionic dispersion liquid of melt-kneaded substance was put, and stirred at 10,000 rpm for 30 minutes at 80° C., thereby performing heteroaggregation. Thus, the toner of Example 2 was prepared.

Example 3

A toner of Example 3 was prepared in the same manner as in Example 2, except for the heteroaggregation step.

| <Heteroaggregation> | |
|---|---|
| Anionic dispersion liquid of melt-kneaded substance: | 571.4 parts |
| Cationic dispersion liquid of release agent: | 28.6 parts |
| Sodium chloride: | 6.0 parts |

These ingredients were put into CREAMIX (trade name, made by M TECHNIQUE Co., LTD.), provided that the anionic dispersion liquid of melt-kneaded substance was put before the cationic dispersion liquid of release agent was put, and stirred at 10,000 rpm for 30 minutes at 80° C., thereby performing heteroaggregation. Thus, the toner of Example 3 was obtained.

Example 4

A toner of Example 4 was prepared in the same manner as in Example 1, except for the heteroaggregation step.

<Heteroaggregation>

A 300 parts portion of the anionic dispersion liquid of melt-kneaded substance and a 300 parts portion of the cationic dispersion liquid of melt-kneaded substance were mixed together, and thereto 3 parts of sodium chloride was added. The resultant mixture was stirred at 15,000 rpm for 30 minutes at 85° C. by means of CREAMIX (trade name, made by M TECHNIQUE Co., LTD.), thereby performing heteroaggregation. Thus, the toner of Example 4 was obtained.

Example 5

A toner of Example 5 was prepared in the same manner as in Example 1, except for the heteroaggregation step.

<Heteroaggregation>

A 300 parts portion of the anionic dispersion liquid of melt-kneaded substance and a 300 parts portion of the cationic dispersion liquid of melt-kneaded substance were mixed together, and thereto 3 parts of sodium chloride was added. The resultant mixture was stirred at 9,000 rpm for 30 minutes at 77° C. by means of CREAMIX (trade name, made by M TECHNIQUE Co., LTD.), thereby performing heteroaggregation. Thus, the toner of Example 5 was obtained.

Comparative Example 1

A toner of Comparative Example 1 was prepared in the same manner as in Example 2, except that a step of preparing a mixture containing the binder resin and the colorant was carried out instead of carrying out the step of preparing the melt-kneaded substance containing the binder resin and the colorant and the mixture is used in place of the melt-kneaded substance.

| <Preparation of Mixture> | |
|---|---|
| Polyester (binder resin, C1469, trade name, manufactured by Mitsubishi Rayon Co., Ltd.; glass transition temperature: 60° C.; softening temperature: 110° C.): | 82.0 parts |
| Charge control agent (N5P, trade name, manufactured by Clariant in Japan): | 2.0 parts |
| Colorant (KET. BLUE111, manufactured by DIC Corporation): | 8.5 parts |

These ingredients were mixed by means of HENSCHEL MIXER (trade name, made by Mitsui Mining Co., Ltd.). Thus, the mixture was obtained.

Comparative Example 2

A toner of Comparative Example 2 was prepared in the same manner as in Example 1, except that the step of preparing the anionic dispersion liquid of melt-kneaded substance was changed to the following step, and the step of preparing the cationic dispersion liquid of melt-kneaded substance was not carried out and moreover, an aggregating step described be low was carried out instead of carrying out the heteroaggregation step.

<Preparation of Anionic Dispersion Liquid of Melt-Kneaded Substance>

An anionic dispersion liquid of melt-kneaded substance was prepared in the same manner as in Example 1, except that sodium alkylbenzenesulfonate (anionic dispersant, NEWCOL 220L (65), trade name, manufactured by Nippon Nyukazai Co., Ltd.) was used in place of polyacrylic acid (anionic dispersant, DISROL H-14-N, trade name, manufactured by Nippon Nyukazai Co., Ltd.).

The sodium alkylbenzenesulfonate used herein is an anionic dispersant comprising a polymer in which an anionic polar group is added to the main chain.

<Aggregation>

Sodium chloride in an amount of 2.4 parts was added to 300 parts of the anionic dispersion liquid of melt-kneaded substance, and stirred at 10,000 rpm for 30 minutes at 80° C. by means of CREAMIX (trade name, made by M TECHNIQUE Co., LTD.), thereby performing aggregation. Thus, the toner of Comparative Example 2 was obtained.

Comparative Example 3

| <Preparation of Melt-kneaded Substance Containing Binder Resin and Colorant> | |
|---|---|
| A melt-kneaded substance of Comparative Example 3 was prepared in the same manner as in Example 2. | |
| <Preparation of Anionic Dispersion Liquid of Release Agent> | |
| Polyethylene wax (release agent, HNP-10, trade name, manufactured by Nippon Seiro Co., Ltd.; melting point: 85° C.): | 180 parts |

-continued

| | |
|---|---|
| Polyacrylic acid (anionic dispersant, Disrol H-14-N, trade name, manufactured by Nippon Nyukazai Co., Ltd.): | 60 parts |
| Ion-exchanged water: | 360 parts |

These ingredients were put into CREAMIX (trade name, made by M TECHNIQUE Co., LTD.) and stirred at 8,000 rpm for 10 minutes at 80° C. Thus, an anionic dispersion liquid of release agent was obtained.

| <Preparation of Cationic Dispersion Liquid of Melt-kneaded Substance> | |
|---|---|
| Melt-kneaded substance: | 400 parts |
| Ion-exchanged water: | 1424 parts |

These ingredients were pulverized at 3,000 rpm for 5 minutes by means of a colloid mill (PUC COLLOID MILL, trade name, made by NIPPON BALL VALVE CO., LTD.). Then, the following ingredients were added to the pulverized matter, and subjected to 5-minute processing for formulation by using Foamless Mixer (trade name, made by Beryu Co., Ltd.) at 3,000 rpm. Thus, kneaded substance slurry was obtained.

| | |
|---|---|
| Alkyldimethylbenzylammonium chloride (cationic dispersant, SANIZOL B-50, manufactured by Kao Corporation): | 133 parts |
| Airrol (surfactant, AIRROL CT-1p, trade name, manufactured by TOHO Chemical Industry Co., Ltd.): | 2.4 parts |
| Xanthan gum (thickener): | 40 parts |

Next, the kneaded substance slurry was pretreated by being put into NANO3000 (trade name, made by Beryu Co., Ltd.) and passed twice through there under 50 MPa at room temperature. Further, the pretreated matter was made finer under 167 MPa at 150° C., thereby preparing a cationic dispersion liquid of melt-kneaded substance.

| <Heteroaggregation> | |
|---|---|
| Anionic dispersion liquid of release agent: | 28.6 parts |
| Cationic dispersion liquid of melt-kneaded substance: | 571.4 parts |
| Sodium chloride: | 6.0 parts |

These ingredients were put into CREAMIX (trade name, made by M TECHNIQUE Co., LTD.), provided that the anionic dispersion liquid of release agent was put before the cationic dispersion liquid of melt-kneaded substance was put, and stirred at 10,000 rpm for 30 minutes at 80° C., thereby performing heteroaggregation. Thus, the toner of Comparative Example 3 was prepared.

TABLE 1

| | Anion | | Cation | | Flocculant | Number of Revolutions | Temperature |
|---|---|---|---|---|---|---|---|
| | | Content (%) | | Content (%) | Content (%) | (rpm) | (° C.) |
| Ex. 1 | Kneaded Substance | 0.3 | Kneaded Substance | 0.3 | 0.5 | 10,000 | 80 |
| Ex. 2 | Kneaded Substance | 0.6 | Release Agent | 0.5 | 1 | 10,000 | 80 |
| Ex. 3 | Kneaded Substance | 0.6 | Release Agent | 0.5 | 1 | 10,000 | 80 |
| Ex. 4 | Kneaded Substance | 0.3 | Kneaded Substance | 0.3 | 0.5 | 15,000 | 85 |
| Ex. 5 | Kneaded Substance | 0.3 | Kneaded Substance | 0.3 | 0.5 | 9,000 | 77 |
| Comp. Ex. 1 | Mixture | 0.3 | Release Agent | 0.5 | 8.5 | 8,000 | 80 |
| Comp. Ex. 2 | Kneaded Substance | 0.3 | — | — | 7.5 | 10,000 | 80 |
| Comp. Ex. 3 | Release Agent | 0.5 | Kneaded Substance | 0.6 | 1 | 10,000 | 80 |

Evaluations were made on the toner samples prepared in the manners mentioned in Examples and Comparative Examples respectively.

<Volume Average Particle Size and Particle Size Distribution of Toner>

20 mg of each sample and 1 ml of sodium alkyl ether sulfate were added to 50 ml of an electrolytic solution (ISOTON-II, trade name, manufactured by Beckman Coulter, Inc.), and subjected to 3 minutes' dispersion processing at an ultrasonic frequency of 20 kHz by means of an ultrasonic dispersing machine (UH-50, trade name, made by SMT Co., Ltd.). Thus, measurement-purpose samples were prepared. By using particle size distribution measuring equipment (Multisizer 3, trade name, made by Beckman Coulter, Inc.) under conditions that the aperture diameter was 100 μm and the number of measured particles was 50,000 counts, measurements were made on each of the measurement-purpose samples, and the volume average particle size and the standard deviation in the volume particle-size distribution were determined from the volume particle-size distribution of sample particles. The coefficient of variation (CV value, %) was calculated on the basis of the following expression (7).

$$\text{CV value}(\%)=(\text{Standard deviation in volume particle-size distribution}/\text{Volume average particle size})\times 100 \quad (7)$$

<Transferability>

Transferability of toner was evaluated by transfer efficiency. The transfer efficiency was defined as the proportion of a toner transferred from the surface of the photoreceptor drum to an intermediate transfer belt in the primary transfer, and worked out by taking the quantity of toner present on the photoreceptor drum before transfer as 100%. The toner present on the photoreceptor drum before transfer was aspirated by means of electrostatic measurement apparatus (210HS-2A, trade name, made by TREK JAPAN K.K.), and the quantity of toner aspirated was measured. Likewise, the quantity of toner transferred to the intermediate transfer belt was further measured. The evaluation standards adopted are as follows.

Excellent: Very favorable. Transfer efficiency is 95% or above.

Good: Favorable. Transfer efficiency is lower than 95% but no lower than 90%

Not Bad: Practically usable. Transfer efficiency is lower than 90% but no lower than 85%.

Poor: Impractical to use. Transfer efficiency is lower than 85%.

<Release Agent Content>

A release agent content W1 (%) in toner particles was worked out by the expression (6). The evaluation standard adopted is as follows.

Good: Release agent content of 6.87% or higher.

Poor: Release agent content lower than 6.87%.

<Cleaning Properties>

A two-component developer containing each of the toner samples prepared in Examples and Comparative Examples respectively was charged into commercially available copying apparatus (AR-C150, trade name, made by Sharp Corporation), and charts having a printed area rate of 5% were continuously printed out on A4-size recording sheets defined by Japanese Industrial Standards (JIS) P0138. After printing on 30,000 recording sheets, test charts were formed. As the test charts, an overall solidly-shaded chart, an overall fine-line chart and a blank sheet (printed area rate of 0%) were formed. Image defects on these three kinds of test charts were ascertained by visual observations, and cleaning properties were evaluated in the light of these observation results. The evaluation standards adopted are as follows.

Good: Favorable. No image defect was detected on any of three kinds of test charts.

Not Bad: Practically usable. Image defects are noticed on one or more kinds of charts, but they are on a practically no-problem level.

Poor: Impractical to use. Image defects are produced on one or more kinds of charts.

<Anti-Filming Properties>

The photoreceptor and the image formed after the chart having an image area rate of 5% was continuously printed out on 100,000 sheets were observed visually, and whether filming was present thereon or not was judged.

Excellent: Very favorable. No occurrence of filming is detected at all.

Good: Favorable. Few traces of adherents are present, but they have no influence upon images.

Not Bad: Practically usable. Traces of adherents are present, but they have little influence upon images.

Poor: Impractical to use. Filming occurs, which has an influence upon images.

<Anti-Blocking Properties>

5 g of a sample toner was put in a beaker having a volume of 100 cc, and rested for 24 hours in a drier kept at 50° C. The aggregation degree of toner after resting was measured with a vibrating screen classifier (POWDER TESTER, tradename, made by Hosokawa Micron Corporation), and thereby anti-blocking properties were evaluated. The measurement was made in the following manner: On a vibrating table, 100-mesh, 200-mesh and 400-mesh screens were stacked vertically in the order of decreasing mesh count (the 400-mesh screen at the bottom), and the sample was put on the 100-mesh screen. The voltage impressed on the vibrating table was set at 15V, the vibrating table amplitude was adjusted to range up to 0.5 mm, and vibrations were applied to the vibrating table for about 15 seconds. Thereafter, the cohesive toner remaining on each screen was weighed, and the aggregation degree of toner was calculated on the basis of the following expression (8).

$$\text{Aggregation degree}=\{[(\text{Weight of sample on 100-mesh screen})\times 1+(\text{Weight of sample on 200-mesh screen})\times 0.6+(\text{Weight of sample on 400-mesh screen})\times 0.2)]/(\text{Weight of sample input})\}\times 100 \quad (8)$$

Rate of change in aggregation degree before and after rest=(Aggregation degree before rest−Aggregation degree after 24-hour rest)/Aggregation degree before rest Excellent: Very favorable. The rate of change in aggregation degree is from 0% to 10%.

Good: Favorable. The rate of change in aggregation degree is greater than 10% but not greater than 20%.

Not Bad: Practically usable. The rate of change in aggregation degree is greater than 20% but not greater than 30%.

Poor: Impractical to use. The rate of change in aggregation degree is greater than 30%.

<High-Temperature Offset Resisting Properties>

The fixing temperature of the image forming apparatus was set differently, and the temperature at which high-temperature offset occurred was determined.

Excellent: Very favorable. The temperature at which high-temperature offset occurs is 210° C. or above.

Good: Favorable. The temperature at which high-temperature offset occurs is lower than 210° C. but not lower than 200° C.

Not Bad: Practically usable. The temperature at which high-temperature offset occurs is lower than 200° C. but not lower than 190° C.

Poor: Impractical to use. The temperature at which high-temperature offset occurs is lower than 190° C.

<Transparency>

Haze values of sample images formed on OHP sheets (OHP FILM IJ188OHP, trade name, produced by Sharp Document Systems Corporation) under developing and fixing conditions allowing optimization of chromaticity and chroma were measured with a haze meter (made by Tokyo Denshoku Co., Ltd.). The smaller haze value indicates the higher transparency. More specifically, the haze values of 20 or below are translated into satisfactory transparency, and those of 15 or below are translated into extremely high transparency. On the other hand, the haze values of 25 or above signify a color toner lacking in practicality. The transparency was evaluated according to the following criteria.

Excellent: Very favorable. The haze value is smaller than 15.

Good: Favorable. The haze value is not smaller than 15 but smaller than 20.

Not Bad: Practically usable. The haze value is not smaller than 20 but smaller than 25.

Poor: Impractical to use. The haze value is 25 or above.

<Transmission Characteristic>

By using each sample toner and test image-forming apparatus prepared by removing the fixing device from a Digital Full Colour Copier/Printer AR-C260 (trade name, made by Sharp Corporation), an unfixed solid image was formed on an OHP sheet (CX7A4C, trade name, produced by Sharp Corporation). The thus formed solid image was placed under a load for 5 minutes in an oven set at 150° C., and formed into smooth toner film having a thickness in a range of 5 to 15 μm. Thus, a measuring sample was prepared. Several measuring samples having different thicknesses were prepared for each sample toner.

The spectral transmittance of each of the thus prepared measuring samples in a wavelength range of 400 nm to 700 nm was measured with a spectrophotometer (U-3200, tradename, made by Hitachi, Ltd.). From the measurement result, the transmittance of each measuring sample at the wavelength of maximum absorption was determined. And the measuring sample having a thickness providing a transmittance of 3% at the wavelength of maximum absorption was selected. The transmittance of the thus selected measuring sample at the wavelength where the sample shows the maximum transmission was determined, and thereby the transmission characteristic of the sample toner was evaluated.

Good: Favorable. The maximum transmittance is 85% or above.

Not Bad: Practically usable. The maximum transmittance is not lower than 80% but lower than 85%.

Poor: Impractical to use. The maximum transmittance is lower than 80%.

<Comprehensive Evaluation>

Excellent: Very favorable. All the evaluation results are evaluated as "Excellent" or "Good".

Good: Favorable. None of the evaluation results is evaluated as "Poor", and only one of the evaluation results is evaluated as "Not Bad".

Not Bad: Practically usable. None of the evaluation results is evaluated as "Poor", and more than one of the evaluation results is evaluated as "Not Bad".

Poor: Impractical to use. One or more of the evaluation results are evaluated as "Poor"

TABLE 2

| | | | Release Agent | | Transferability | | | |
|---|---|---|---|---|---|---|---|---|
| | Particle | CV | Content | | Transfer | | | |
| | Size (μm) | Value (%) | Content wt % | Evaluation | Efficiency (%) | Evaluation | Cleaning Properties | Anti-Filming Properties |
| Ex. 1 | 5.4 | 23 | 6.98 | Good | 93 | Good | Good | Not Bad |
| Ex. 2 | 5.3 | 25 | 7.28 | Good | 91 | Good | Good | Good |
| Ex. 3 | 5.1 | 28 | 7.13 | Good | 90 | Good | Good | Not Bad |
| Ex. 4 | 5.4 | 23 | 6.90 | Good | 95 | Excellent | Good | Not Bad |
| Ex. 5 | 5.4 | 23 | 7.05 | Good | 90 | Good | Excellent | Not Bad |
| Comp. Ex. 1 | 5.6 | 28 | 6.60 | Poor | 94 | Good | Good | Good |
| Comp. Ex. 2 | 5.0 | 26 | 6.75 | Poor | 93 | Good | Not Bad | Not Bad |
| Comp. Ex. 3 | 5.3 | 24 | 7.13 | Good | 83 | Poor | Good | Poor |

TABLE 2-continued

| | Anti-Blocking Properties | High Temperature Offset Resisting properties | Transparency | Transmission Characteristic Transmittance (%) | Transmission Characteristic Evaluation | Comprehensive Evaluation |
|---|---|---|---|---|---|---|
| Ex. 1 | Good | Good | Good | 88 | Good | Good |
| Ex. 2 | Excellent | Good | Good | 89 | Good | Excellent |
| Ex. 3 | Good | Good | Good | 87 | Good | Good |
| Ex. 4 | Good | Good | Good | 86 | Good | Good |
| Ex. 5 | Good | Good | Good | 88 | Good | Good |
| Comp. Ex. 1 | Not Bad | Not Bad | Poor | 78 | Poor | Poor |
| Comp. Ex. 2 | Not Bad | Not Bad | Good | 84 | Not Bad | Not Bad |
| Comp. Ex. 3 | Good | Good | Good | 88 | Good | Poor |

The toner obtained in Example 1 was rated good on all criteria except anti-filming properties. The anti-filming properties of this toner were on a practically usable level, and the influence thereof on image quality was not observed. The toner obtained in Example 2 was rated excellent or good on all criteria. This result is thought to be attributed to the situation that the release agent was enclosed within the melt-kneaded substance.

Although the release agent in the toner obtained in Example 3 was also enclosed within the melt-kneaded substance as in the case of Example 2, the dispersion liquid of release agent was added to the dispersion liquid of melt-kneaded substance. Therefore, the toner obtained Example 3 was rated somewhat lower as compared with the toner obtained in Example 2 where the dispersion liquid of melt-kneaded substance was added to the dispersion liquid of release agent.

In Example 4, the heteroaggregation for toner making was carried out under conditions that the number of revolutions was greater and the temperature was higher as compared with those in Example 1. Therefore, the toner became closer to spherical in shape and the transferability thereof was enhanced. In contrast to Example 4, the heteroaggregation for making the toner in Example 5 was carried out under conditions that the number of revolutions was smaller and the temperature was lower as compared with those in Example 1. Therefore, the toner shape deviated from a sphere and became irregular. Thereby, the cleaning properties were improved.

The toner obtained in Comparative Example 1 didn't use the melt-kneaded substance, but the mixture. Therefore, the transparency was lowered. In Comparative Example 2, the toner was made without heteroaggregation, so the flocculant usage was increased to result in degradation of its properties as a whole. In the toner making of Comparative Example 3, the anionic dispersion liquid of release agent and the cationic dispersion liquid of melt-kneaded substance were subjected to heteroaggregation. Therefore, cations remained on the toner surface, and caused reduction in chargeability of the toner; as a result, filming was prone to occur.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner, comprising:

melt-kneading at least a binder resin, a colorant and a release agent to form a melt-kneaded product, dispersing said melt-kneaded product in a separate first dispersion liquid and a separate second dispersion liquid to form a first dispersed melt-kneaded product and a second dispersed melt-kneaded product, wherein said first dispersion liquid and said second dispersion liquid have opposite polarity, and aggregating the first dispersed melt-kneaded product and the second dispersed melt-kneaded product through heteroaggregation by mixing the first dispersion melt-kneaded product and the second dispersion melt-kneaded product.

2. The method of claim 1, wherein the melt-kneading is carried out in the presence of a charge control agent.

3. The method of claim 1, wherein the first dispersion liquid and the second dispersion liquid are selected from an anionic dispersant containing a polymer binding an anionic polar group to its main chain and a cationic dispersant containing a univalent, divalent or trivalent metal salt.

4. The method of claim 1, further comprising heating an aggregated product of said aggregating for control of toner shape.

5. The method of claim 4, wherein a heating temperature in the heating is equal to or higher than a glass transition temperature of the binder resin, and equal to or lower than a softening temperature of the binder resin.

6. A method of manufacturing a toner, comprising: melt-kneading at least a binder resin and a colorant to form a melt-kneaded product, dispersing said melt-kneaded product in a separate first dispersion liquid of an anionic dispersant and a release agent in a separate second dispersion liquid of a cationic dispersant to form a first dispersed melt-kneaded product from said first dispersion liquid and a dispersed release agent from said second dispersion liquid, and aggregating the first dispersed melt-kneaded product and the dispersed release agent through heteroaggregation by mixing the dispersed melt-kneaded product and the dispersed release agent.

7. The method of claim 6, wherein the melt-kneaded product contains a charge control agent.

8. The method of claim 6, wherein when the volume average particle size of the release agent is denoted by a (μm), the volume average particle size of the dispersed melt-kneaded product is denoted by b(μm), the release agent content in the toner is denoted by c (%) and the volume average particle size of the toner is denoted by d (μm), relations of $a/10 \leqq b \leqq (d-a)/2$ and $100*\{a/(a+2b)\}^3 \geqq c$ are satisfied.

9. The method of claim 6, wherein the anionic dispersant is an anionic dispersant containing a polymer binding an anionic polar group to its main chain and the cationic dispersant is a cationic dispersant containing a univalent, divalent or trivalent metal salt.

10. The method of claim 6, further comprising heating an aggregated product of said aggregating for control of toner shape.

11. The method of claim 10, wherein a heating temperature in the heating is equal to or higher than a glass transition temperature of the binder resin, and equal to or lower than a softening temperature of the binder resin.

* * * * *